US007097216B2

(12) United States Patent
Lane et al.

(10) Patent No.: US 7,097,216 B2
(45) Date of Patent: Aug. 29, 2006

(54) LATCH ASSEMBLY FOR MOVABLE CLOSURE ELEMENT

(75) Inventors: Christopher M. Lane, Nashua, IA (US); Craig Helton, Charles City, IA (US); Dennis J. Zweibohmer, Ionia, IA (US); Joe Daniel Knight, Nashua, IA (US); Ricci L. Marzolf, New Hampton, IA (US)

(73) Assignee: Tri/Mark Corporation, New Hampton, IA (US)

( * ) Notice: Subject to any disclaimer, the term of this patent is extended or adjusted under 35 U.S.C. 154(b) by 0 days.

(21) Appl. No.: 10/316,367

(22) Filed: Dec. 11, 2002

(65) Prior Publication Data

US 2004/0113434 A1 Jun. 17, 2004

(51) Int. Cl.
*E05C 3/06* (2006.01)

(52) U.S. Cl. ..... 292/216; 292/24; 292/56; 292/336.3

(58) Field of Classification Search ..... 292/216, 292/11, 24, 27, 56, 336.3, 26
See application file for complete search history.

(56) References Cited

U.S. PATENT DOCUMENTS

| | | | | | |
|---|---|---|---|---|---|
| 621,574 | A | * | 3/1899 | Kinsey | 292/24 |
| 1,059,952 | A | * | 4/1913 | Spooner | 292/336.3 |
| 2,700,290 | A | * | 1/1955 | Dall | 70/135 |
| 3,214,947 | A | * | 11/1965 | Wikkerink | 70/92 |
| 3,287,054 | A | * | 11/1966 | Russell et al. | 292/336.3 |
| 3,784,241 | A | * | 1/1974 | Pickles | 292/216 |
| 3,843,175 | A | | 10/1974 | Klebba | |
| 4,123,097 | A | * | 10/1978 | Allemann | 292/336.3 |
| 4,506,922 | A | * | 3/1985 | Horgan, Jr. | 292/336.3 |
| 4,511,166 | A | * | 4/1985 | Weinerman | 292/29 |
| 4,835,997 | A | * | 6/1989 | Akright | 70/141 |
| 4,836,707 | A | * | 6/1989 | Myers | 403/322.4 |

(Continued)

FOREIGN PATENT DOCUMENTS

DE 3438552 4/1986

(Continued)

*Primary Examiner*—Brian E. Glessner
*Assistant Examiner*—Carlos Lugo
(74) *Attorney, Agent, or Firm*—Wood, Phillips, Katz, Clark & Mortimer

(57) ABSTRACT

A latch assembly for a movable closure element of the type having first and second sides. The latch assembly has a housing, a first rotor movable relative to the housing selectively between a) a latched position and b) a release position, and an operating assembly which is operable to change the first rotor from the latched position into the release position. A first rotor is engageable with a strike element relative to which the movable closure element can be moved to thereby releasably maintain the movable closure element in a desired position. The first rotor is biased towards the release position. The operating assembly includes a catch block assembly that is movable selectively between a) an engaged position wherein the first rotor is maintained in the latched position and b) a disengaged position wherein the first rotor is permitted to move from the latched position into the release position. The operating assembly further includes a first actuating assembly for mounting on the first side of the movable closure. The first actuating assembly has a first normal state and a first release state. The first actuating assembly directly engages the catch block assembly and causes the catch block assembly to change from the engaged position into the release position as an incident of the first actuating assembly changing from the first normal state into the first release state.

37 Claims, 19 Drawing Sheets

U.S. PATENT DOCUMENTS

| | | | | | |
|---|---|---|---|---|---|
| 4,895,399 | A | * | 1/1990 | Horgan, Jr. | 292/92 |
| 4,951,486 | A | * | 8/1990 | Braun et al. | 70/208 |
| 4,982,986 | A | * | 1/1991 | Gressett et al. | 292/336.3 |
| 5,071,179 | A | | 12/1991 | Brackmann | |
| 5,085,474 | A | * | 2/1992 | Toledo et al. | 292/92 |
| 5,127,686 | A | * | 7/1992 | Gleason et al. | 292/216 |
| 5,209,530 | A | * | 5/1993 | Kolloch | 292/27 |
| 5,520,423 | A | * | 5/1996 | Finkelstein et al. | 292/146 |
| 5,700,044 | A | * | 12/1997 | Wartian | 292/336.3 |
| 5,725,262 | A | | 3/1998 | Kritzler | |
| 5,791,703 | A | | 8/1998 | Kritzler et al. | |
| 5,860,684 | A | | 1/1999 | Mizuki | |
| 5,887,918 | A | | 3/1999 | Okada et al. | |
| 5,975,597 | A | | 11/1999 | Makiuchi et al. | |
| 5,983,682 | A | * | 11/1999 | Parikh | 70/208 |
| 5,984,383 | A | * | 11/1999 | Parikh et al. | 292/121 |
| 6,108,979 | A | | 8/2000 | Saffran et al. | |
| 6,131,989 | A | | 10/2000 | Montone et al. | |
| 6,234,548 | B1 | | 5/2001 | Mittelbach et al. | |
| 6,415,636 | B1 | | 7/2002 | Fukumoto et al. | |
| 6,419,284 | B1 | * | 7/2002 | Kutschat | 292/56 |
| 6,454,321 | B1 | * | 9/2002 | Parikh | 292/216 |
| 6,651,467 | B1 | * | 11/2003 | Weinerman et al. | 70/208 |
| 2001/0006293 | A1 | * | 7/2001 | Rupp | 292/336.3 |

FOREIGN PATENT DOCUMENTS

| | | |
|---|---|---|
| DE | 3911327 | 10/1990 |
| DE | GM9012540 | 3/1991 |
| DE | GM9314843 | 3/1995 |
| EP | 0795667 | 9/1997 |
| EP | 0807729 | 11/1997 |
| EP | 1026351 | 8/2000 |
| GB | 0765268 A | 1/1957 |
| GB | 1187253 | 4/1970 |
| WO | WO 99/49162 | 9/1999 |
| WO | WO 01/14665 | 3/2001 |
| WO | WO 01/27418 | 4/2001 |

* cited by examiner

LATCH ASSEMBLY FOR MOVABLE CLOSURE ELEMENT

BACKGROUND OF THE INVENTION

1. Field of the Invention

This invention relates to latch assemblies for releasably maintaining movable closure elements in a desired position relative to a support therefor.

2. Background Art

Myriad designs for latch assemblies for maintaining movable closure elements in a desired position relative to a support upon which the movable closure element is mounted have been devised over the years. Different demands are placed upon these mechanisms depending upon their particular environment. However, designers of these latch assemblies universally consider and balance the following factors in their designs: 1) reliability; 2) holding capacity; 3) convenience of operation; 4) ease of manufacture; 5) ease of assembly; 6) versatility; and 7) cost. Certain of the above factors are competing in the design process and, generally, particular applications will dictate where compromises must be made. Ideally, one would optimize each of these design areas.

The agricultural and construction industries are ones in which rather severe demands are placed upon latch assemblies. Severe stresses are commonly placed on closure elements on cabs of tractors and the like. At the same time, convenience of actuation is a prime consideration, as when a hasty exit must be made from such a vehicle. This has lead to the use of squeeze-actuated assemblies of the type shown in U.S. Pat. No. 6,419,284. The squeeze actuator is integrated into a bar which facilitates manipulation of the closure element as well as accessibility to the lever that is squeezed while gripping the bar to release the latch assembly to permit opening of the closure element. However, the latch assembly designs, of the type shown in U.S. Pat. No. 6,419,284, have tended towards the complicated. For example, the design shown in U.S. Pat. No. 6,419,284 uses two separate, indirect mechanisms for moving a catch element through separate internal and external actuating assemblies on the closure element. This indirect actuation requires intermediate parts which may complicate the manufacturing process and increase associated costs. Indirect mechanisms, by their nature, introduce additional parts movement that could account for a field failure.

The industry is constantly seeking out latch assemblies that are improved in one or more of the areas noted above.

SUMMARY OF THE INVENTION

In one form, the invention is directed to a latch assembly for a movable closure element of the type having first and second sides. The latch assembly has a housing, a first rotor movable relative to the housing selectively between a) a latched position and b) a release position, and an operating assembly which is operable to change the first rotor from the latched position into the release position. A first rotor is engageable with a strike element relative to which the movable closure element can be moved to thereby releasably maintain the movable closure element in a desired position. The first rotor is biased towards the release position. The operating assembly includes a catch block assembly that is movable selectively between a) an engaged position wherein the first rotor is maintained in the latched position and b) a disengaged position wherein the first rotor is permitted to move from the latched position into the release position. The operating assembly further includes a first actuating assembly for mounting on the first side of the movable closure. The first actuating assembly has a first normal state and a first release state. The first actuating assembly directly engages the catch block assembly and causes the catch block assembly to change from the engaged position into the release position as an incident of the first actuating assembly changing from the first normal state into the first release state.

In one form, the operating assembly further includes a second actuating assembly for mounting on the second side of the movable closure element. The second actuating assembly has a second normal state and a second release state. The second actuating assembly directly engages the catch block assembly and causes the catch block assembly to change from the engaged position into the release position as an incident of the second actuating assembly changing from the second normal state into the second release state.

In one form, the housing, first rotor, catch block assembly, and first actuating assembly define a first subassembly that is selectively separable and operably connectable as a unit to the second actuating assembly.

In one form, the first rotor is movable between the latched position and release position around a first axis.

In one form, the operating assembly includes a catch arm that is pivotable relative to the housing about a second axis between first and second positions. The catch block assembly is mounted to the catch arm and is movable pivotably relative to the catch arm around a third axis.

In one form, the first, second, and third axes are substantially parallel to each other.

In one form, the catch block assembly includes a catch block and an adaptor. The adaptor secures the catch block to the catch arm and defines a first surface that is directly engageable by the first actuating assembly.

In one form, the catch block and adaptor are movable as one piece as the catch block assembly moves between the engaged and disengaged positions.

In one form, the first surface is defined by a cantilevered first post.

In one form, the second actuating assembly directly engages the catch block assembly and causes the catch block assembly to change from the engaged position into the disengaged position as an incident of the second actuating assembly changing from the second normal state into the second release state. In this form, the catch block assembly defines a second surface that is directly engageable by the second actuating assembly.

The second surface may be defined by a cantilevered post. The first surface may likewise be defined by a cantilevered post.

In one form, the latch assembly further has a second rotor that is movable relative to the housing between a latched position and a release position. The first and second rotors each have a throat to receive a strike element and are configured so that the first and second rotors cooperatively captively engage a strike element with the first and second rotors in their latched positions.

In one form, the first actuating assembly has a flat mounting surface to abut to the first side of the movable closure element and a cantilevered connecting element which projects past the mounting surface and engages the catch block assembly.

In one form, the first actuating assembly has a base which defines the mounting surface and a first actuating handle which is pivotably attached to the base for movement about a first axis between normal and release positions. The cantilevered connecting element is moved in a path as one piece with the first actuating handle transversely to the mounting surface as the first actuating handle is moved between the normal and release positions.

In one form, the cantilevered connecting element has a length extending along a first line and a first reference plane containing the first line is substantially orthogonal to a second reference plane containing the axis about which the actuating handle pivots.

In one form, the first actuating handle is U-shaped and defines a graspable base and spaced first and second legs. The first leg is pivotably attached to the base, with the cantilevered connecting element on the second leg.

In one form, the cantilevered connecting element has an opening and the catch block assembly has a post. The cantilevered connecting element is engaged with the catch block assembly by directing the post into the opening of the cantilevered connecting element without requiring any separate fasteners acting between the cantilevered connecting element and the post.

The latch assembly may further include a locking assembly having a locked state and an unlocked state. The locking assembly in the locked state prevents movement of the first actuating handle from the normal position into the release position.

In one form, the locking assembly includes a key operated tab which directly blocks the cantilevered connecting element with the locking assembly in the locked state.

In one form, the cantilevered connecting element has a length extending along a first line and is engageable with the post on the catch block assembly with the first actuating assembly moved around the first line through a range of at least 90° relative to the housing.

In one form, the catch block assembly is movable as one piece between the engaged and disengaged positions, the first actuating assembly has a base which defines the mounting surface and a first actuating handle which is pivotably attached to the base for movement about a first axis between normal and release positions, the cantilevered connecting element is moved in a path as one piece with the first actuating handle transversely to the mounting surface as the first actuating handle is moved between the normal and release positions, and the cantilevered connecting element is directly engaged with the catch block assembly.

The invention contemplates the latch assembly, as described above, in combination with a movable closure element having first and second sides.

The invention is further directed to a latch assembly for a movable closure element having first and second sides. The latch assembly has a housing, a first rotor movable relative to the housing selectively between a) a latched position and b) a release position, and an operating assembly which is operable to change the first rotor from the latched position into the release position. The first rotor is engageable with a strike element relative to which the movable closure element can be moved to thereby releasably maintain the movable closure element in a desired position. The first rotor is biased towards the release position. The operating assembly includes a catch block assembly that is movable selectively between a) an engaged position wherein the first rotor is maintained in the latched position and b) a disengaged position wherein the rotor is permitted to move from the latched position into the release position. The operating assembly further includes a first actuating assembly for mounting on the first side of the movable closure element. The first actuating assembly has a first normal state and a first release state. The first actuating assembly has a mounting surface to abut to the first side of the movable closure element and a projecting element which projects past the mounting surface and engages the catch block assembly. The first actuating assembly has a mounting base which defines the mounting surface and a first actuating handle which is pivotably attached to the mounting base for movement about a first axis between normal and release positions. The first handle is U-shaped and defined by a graspable base and spaced first and second legs. The first leg is pivotably attached to the mounting base. The projecting element is in a fixed position on the second leg so that as the actuating handle is pivoted from the normal position into the release position, the projecting element moves as one piece with the second leg and causes the rotor to be changed from the latched position into the release position.

In one form, the projecting element has an opening and the catch block assembly has a post. The projecting element is engaged with the catch block assembly by directing the post into the opening in the projecting element.

In one form, the post is maintained in the opening in the projecting element without requiring a separate fastener acting between the projecting element and the post.

The latch assembly may further include a locking assembly having a locked state and an unlocked state. The locking assembly in the locked state prevents movement of the first actuating handle from the normal position into the release position.

The locking assembly may include a key operated locking tab which directly blocks the projecting element with the locking assembly in the locked state.

In one form, the projecting element has a length extending along a first line that is engageable with the post on the catch block assembly with the first actuating assembly moved around the first line through a range of at least 90° relative to the housing.

In one form the mounting surface is flat.

In one form, the mounting base has a length and a width and the flat mounting surface extends over substantially the entire length of the base.

The invention further contemplates the latch assembly, as described above, in combination with a movable closure element having first and second sides.

DETAILED DESCRIPTION OF THE DRAWINGS

Figure 1:
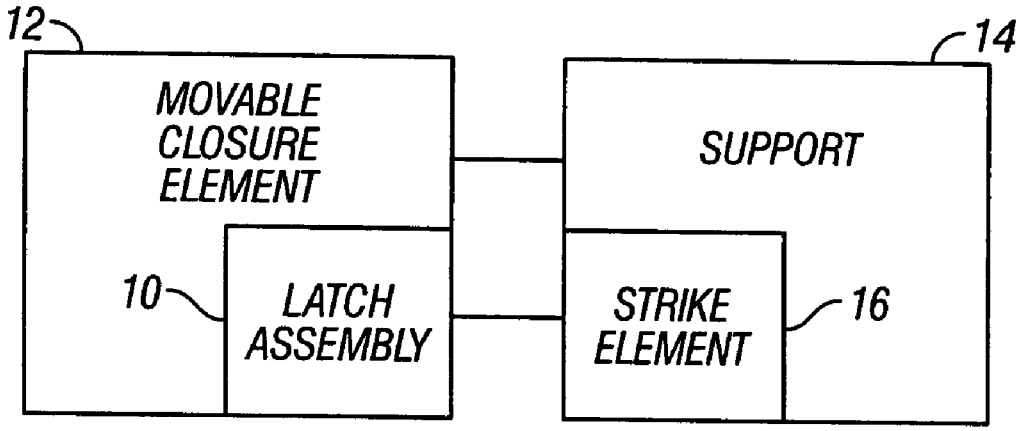
FIG. 1 is a schematic representation of a system including a latch assembly, according to the present invention, mounted upon a closure element which is movable relative to a support and which coacts with a strike element on the support to maintain the closure element in a desired position.

Referring initially to FIG. 1, a latch assembly 10, according to the present invention, is shown on a closure element 12 mounted upon a support 14. The closure element 12 is selectively movable relative to the support 14 between different positions. The latch assembly 10 cooperates with a strike element 16 on the support 14 to releasably maintain the movable closure element 12 in a desired position. The inventive latch assembly 10 is shown in a generic form in FIG. 1 since it can be used on virtually any type of movable closure element in any type of environment. One representative environment for the latch assembly 10 is upon a movable closure element 12 such as an access door, on a support 14 in the form of a piece of agricultural or construction equipment, such as a tractor. However, the latch assembly 10 can be used in other dynamic and static environments, with the operation thereof being substantially the same in each.

Figure 2:
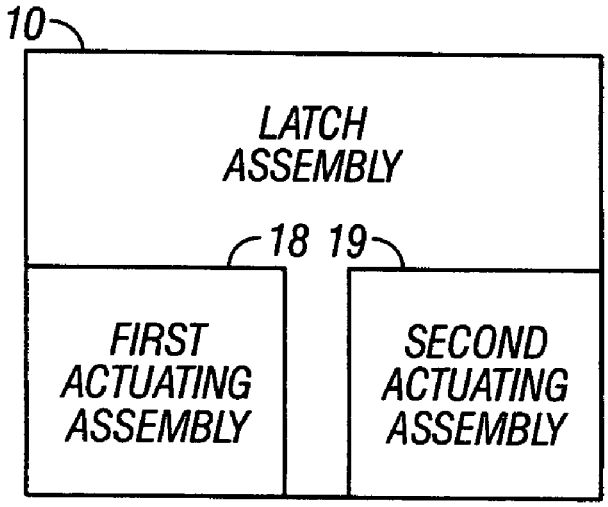
FIG. 2 is a schematic representation of the inventive latch assembly in FIG. 1 and showing first and second separate actuating assemblies therefor.
Figure 3:
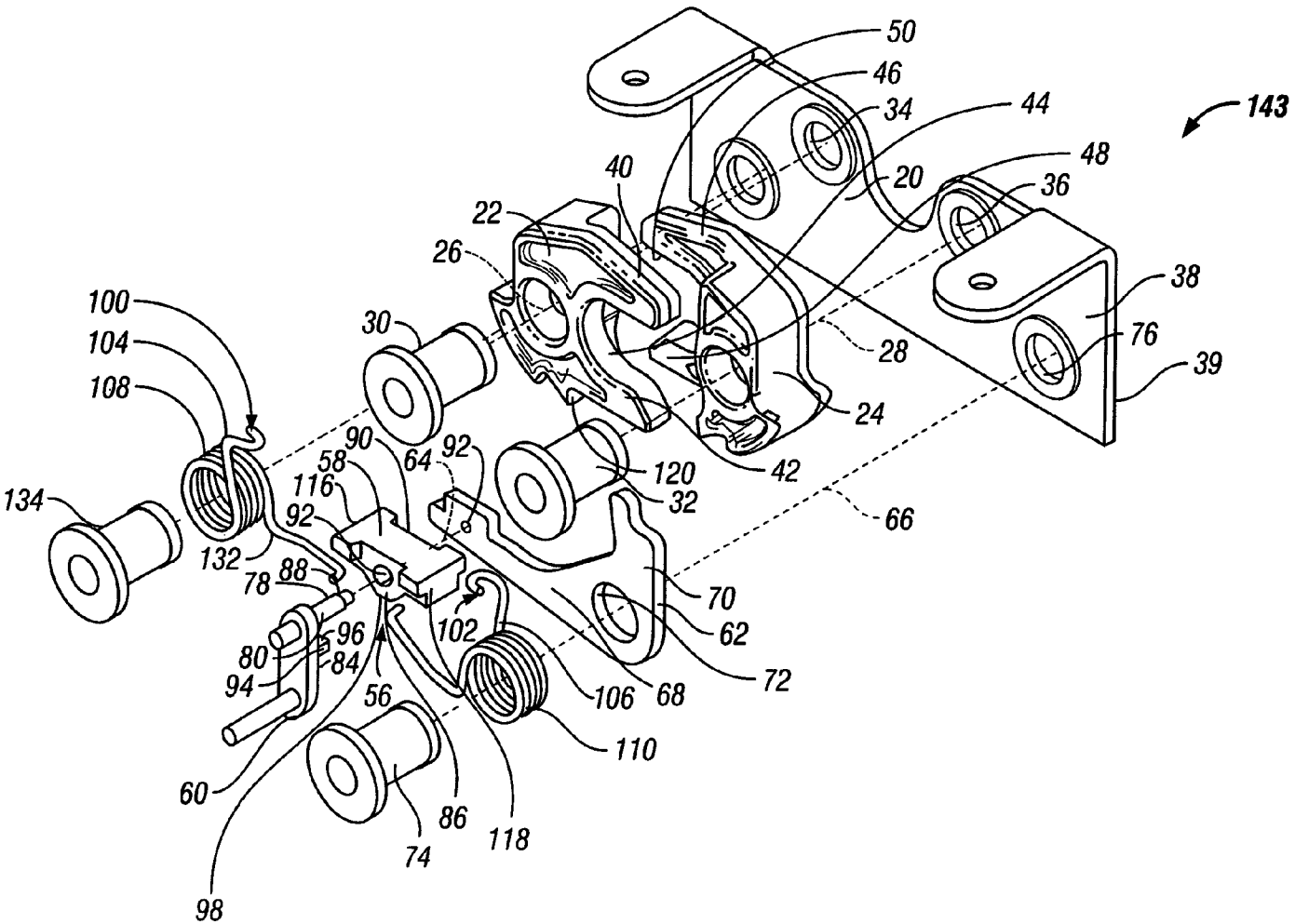
FIG. 3 is an exploded, perspective view of a latching subassembly on the latch assembly, according to the present invention, and including a pair of pivoting rotors.

As shown in FIG. 2, the latch assembly 10 is operable by first and second actuating assemblies 18, 19 provided on opposite sides of the movable closure element 12 for independent interior and exterior operation of the latch assembly 10. The first and second actuating assemblies 18, 19 will be described herein in one form. However, it should be understood that both of the actuating assemblies 18, 19 could have a substantially different form than the exemplary forms described herein.

The first and second actuating assemblies 18, 19 are part of an overall operating assembly which is responsible for causing the latch assembly 10 to release the strike element 16 to permit repositioning of the movable closure element 12 from a particular position therefor that is maintained with the latch assembly 10 holding the strike element 16. More particularly, as shown in FIGS. 3–7, the latch assembly 10 has a housing 20 to which a pair of cooperating rotors 22, 24 are mounted for pivoting movement about parallel axes 26, 28, respectively. The rotors 22, 24 may have the same construction, as shown, or a different construction. The rotors 22, 24 are mounted on the housing by axles 30, 32, which extend through openings 34, 36 in a housing wall 38 and are fixed by being deformed at an outer surface 39 of the wall 38. The rotors 22, 24 are journalled for rotation, one each, around the axles 30, 32.

The rotor 22 has a U-shaped free end with projecting legs 40, 42, which bound a throat 44. The rotor 24 has corresponding legs 46, 48 bounding a throat 50. The rotors 22, 24 are mounted upon the axles 30, 32 so as to cooperate in a scissors-type action as they each move between a release position, shown in FIG. 4, and a primary latched position, as shown in FIGS. 3 and 5–7. With the rotors 22, 24 in the release position of FIG. 4, movement of the rotors 22, 24 against the strike element 16, as by repositioning of the movable closure element 12, causes the strike element 16 to be directed in the direction of the arrow 51 in FIG. 4. The strike element 16 progressively cams the rotors 22, 24 so that they are pivoted in the direction of the arrows 52, 53 about their axes 26, 28, respectively. Continued movement of the strike element 16 against the rotors 22, 24 causes the legs 40, 42, 46, 48 to cooperatively fully surround an opening 54 within which the strike element 16 becomes captive with the rotors 22, 24 in their primary latched positions.

The rotors 22, 24 are maintained in their primary latched positions by a catch block assembly at 56 consisting of a catch block 58 and an adaptor 60, attached thereto and performing a function as hereinafter described. The catch block 58 is mounted to an L-shaped catch arm 62 for pivoting movement about an axis 64. The catch arm 62 is in turn mounted to the housing 20 for pivoting movement around an axis 66. The catch arm 62 has long and short legs 68, 70 at the juncture of which an opening 72 is formed to received a mounting axle 74 which is mounted in an opening 76 in the housing 20 and deformed where it is exposed at the surface 39 so as to be fixed thereto.

The adaptor 60 has a post 78 with a stepped diameter. A larger diameter portion 80 of the post 78 is guided within a bore 82 through the catch block 58. With a flat surface 84 at the base of the post 78 abutting to a surface 86 on the catch block 58, a reduced diameter portion 88 of the post 78 projects beyond the catch block surface 90 facing oppositely to the surface 86, and fixedly into a bore 92 adjacent to the free end of the long leg 68 of the catch arm 62. The adaptor 60 has a tab 94 projecting in the same direction as the post 78 from the adaptor surface 84 and having an upwardly facing surface 96 which bears on a flat, downwardly facing surface 98 on the catch block 58 so as to prevent pivoting movement of the adaptor 60 relative to the catch block 58. Resultingly, the adaptor 60 and catch block 58 move together as one piece in operation.

The rotors 22, 24 are biased about their respective axes 26, 28 by free ends 100, 102 of projecting arms 104, 106 on coil torsion springs 108, 110. The free end 100 of the spring 108 continuously exerts a bias on a shoulder 112 on the rotor 22, thereby urging the rotor 22 in a counterclockwise direction around the axis 26 in FIG. 4 towards the release position. The arm 102 on the spring 110 acts in like manner on a shoulder 114 on the rotor 24 to urge the rotor 24 in a clockwise direction about its axis 28 in FIG. 4 towards its release position.

Figure 4:
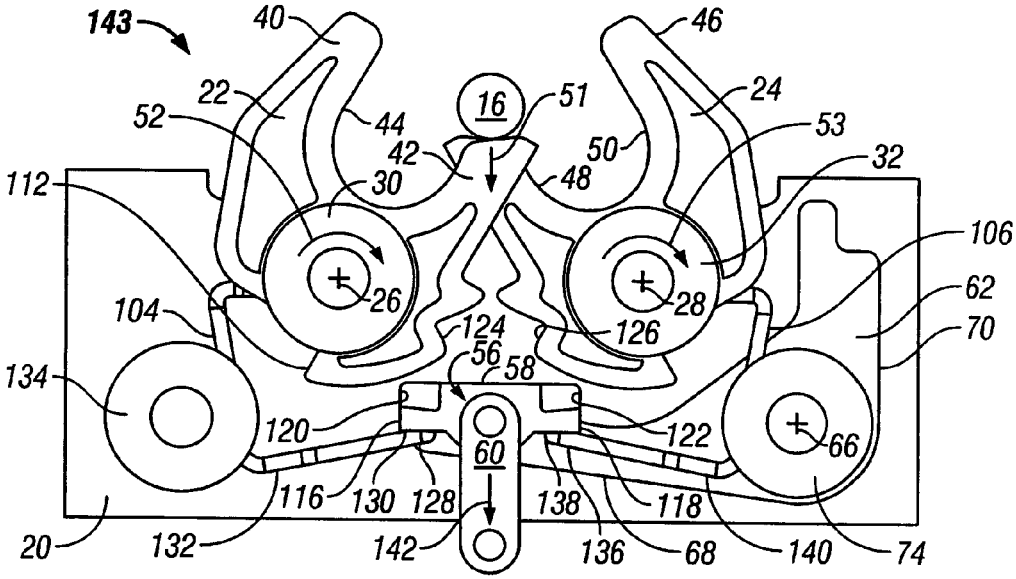
FIG. 4 is side elevation view of the latching subassembly in FIG. 3 with the rotors in a release position.
Figure 5:
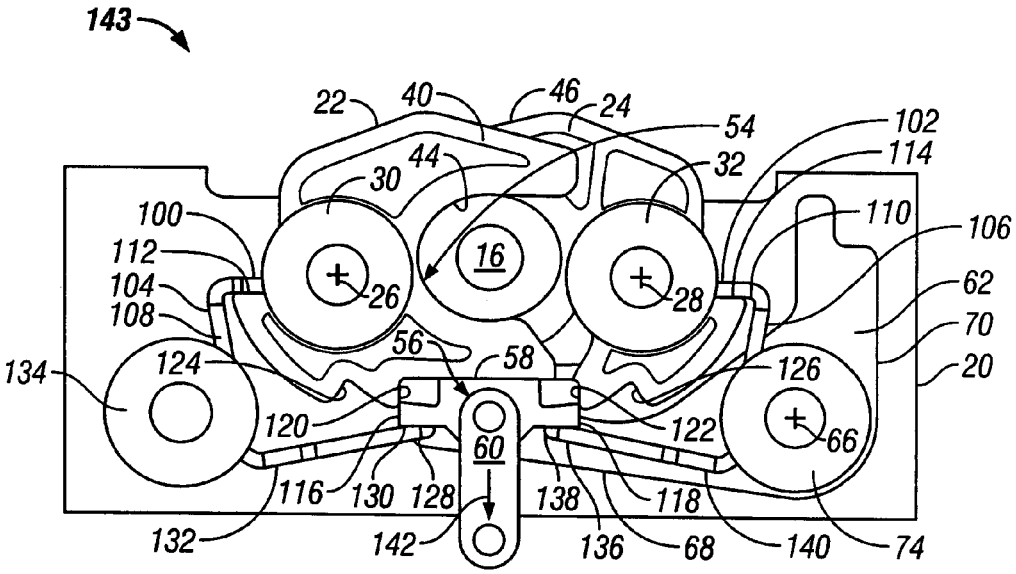
FIG. 5 is a view as in FIG. 4 with the rotors in a latched position.

The rotors 22, 24 are maintained in their primary latched positions in FIG. 5 by oppositely facing catch block surface 116, 118, which bear bearing respectively on stop surfaces 120, 122 on the rotors 22, 24, respectively. Separate stop surfaces 124, 126 on the rotors 22, 24 bear against the catch block surfaces 116, 118 to maintain the rotors 22, 24 in a secondary latched position (not shown), which is between the primary latched position of FIG. 5 and the release position of FIG. 4.

The springs 108, 110 are also responsible for cooperatively bearing the catch block assembly 56 upwardly to against the rotors 22, 24. More specifically, the free end 128 of the spring 108 opposite to the free end 100 bears on a downwardly facing shoulder 130. The free end 128 is at the extremity of an arm 132 projecting from the coiled portion of the spring 108 which surrounds an axle 134. Similarly, the free end 136 of the spring 110, opposite to the free end 102 of the spring 110 bears upon a shoulder 138 on the catch block 58. The free end 136 is carried on an arm 140 projecting from the coiled portion of the spring 110 which is supported on the axle 74, which additionally guides pivoting movement of the catch arm 62.

Figure 6:
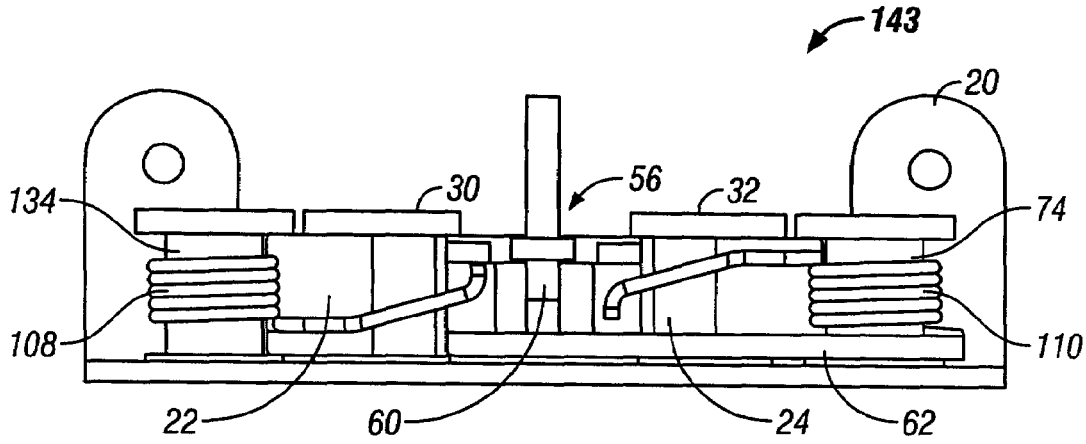
FIG. 6 is a front elevation view of the latching subassembly in FIG. 5.
Figure 7:
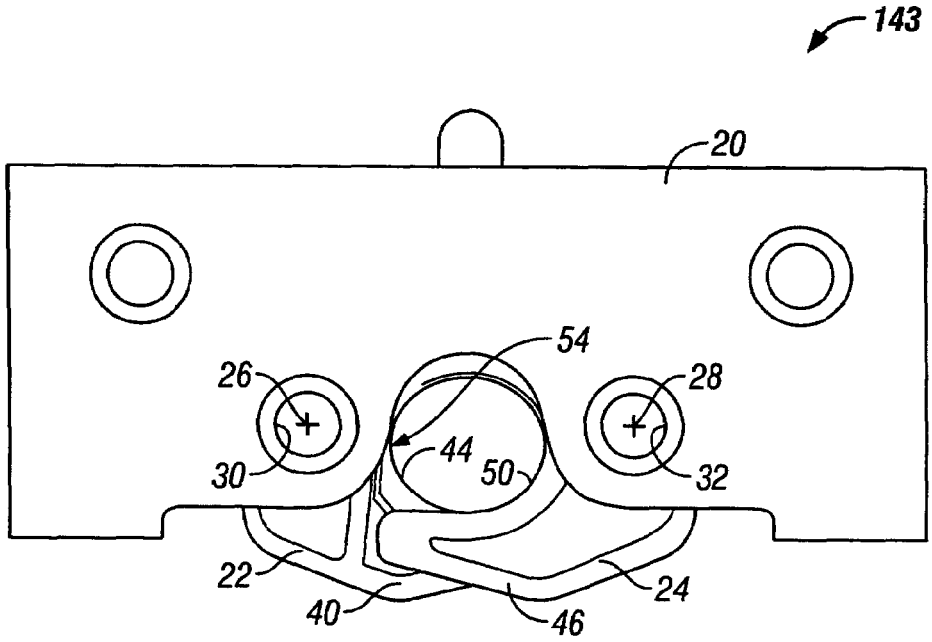
FIG. 7 is an inverted view of the latching subassembly from the side opposite that in FIG. 5.

In operation, with the rotors 22, 24 in their release position of FIG. 4, movement of the strike element 16 against the rotors 22, 24, by reason of repositioning of the movable closure element 12, cams the rotors 22, 24 simultaneously from the FIG. 4 release position towards the latched position of FIGS. 5–7. As this occurs, the catch block assembly 56 is urged against the moving rotor 22, 24 until the catch block assembly 56 aligns with the stop surfaces 124, 126 thereon. The movable closure element 12 can be maintained in the previously described, secondary latched position if the strike element 16 is not caused to be urged with any additional force against the rotors 22, 24. Continued movement of the closure element 12 ultimately causes the catch block assembly 56 to align with the stop surfaces 120, 122 and to be driven upwardly into confronting relationship therewith so that the rotors 22, 24 are each maintained in their primary latched positions.

When it is desired to reposition the movable closure element 12, the catch block assembly 56 has to be moved downwardly, in the direction of the arrow 142 (FIG. 5) substantially along a first reference line indicated by the arrow 142, until the catch block assembly 56 clears the stop surfaces 120, 122, whereupon the springs 108, 110 urge the rotors 22, 24 back towards their release positions. Because the catch block assembly 56 is allowed to pivot/float around the axis 64, the angular orientation of the catch block assembly 56 relative to the catch arm 62 can be consistently maintained as it is moved downwardly in the direction of the arrow 142. This avoids binding between the catch block 56 and rotors 22, 24.

The housing 20 and components mounted thereto, together define a latching subassembly 143. According to the invention, the operation of the latching subassembly 143, by repositioning of the catch block assembly 56, can be directly accomplished independently through either of the first and second actuating assemblies 18, 19. The details of the first actuating assembly 18 are shown in FIGS. 8–17. The first actuating assembly 18 consists of a trip lever 144 which is mounted for pivoting movement relative to a mounting plate 146, that is fixed to the housing 20 through the axles 30, 32. The latching subassembly 143 and the first actuating assembly 18 are thus joined as a combined subassembly that can be assembled to, and disassembled from, the movable closure element 12 and the second operating assembly 19. The trip lever 144 has an elongate operating portion 148 at one end and is bifurcated at its opposite end to define spaced legs 150, 152 which are received between spaced ears 154, 156 on the mounting plate 146. The legs 150, 152 in turn straddle a trip latch 158. A pin 160 extends through the trip lever 144, trip latch 158, and the ears 154, 156 to maintain the same in operative relationship wherein the trip lever 144 and trip latch 158 are pivotable about a common axis 162 defined by the pin 160.

The trip latch 158 has a shoulder 164 which bears directly against a surface 166 defined by a post 168 that is an extension of the post 78 on the adaptor 60 through which the catch block 58 is mounted. The post 168 projects in cantilever fashion. By pivoting the trip latch 158 in a counterclockwise direction, as indicated by the arrow 170 in FIG. 16, the trip latch shoulder 164 moves substantially parallel to the first line, as indicated by the arrow 142, and bears directly against the post surface 166 and drives the catch block assembly 56 in the direction of the arrow 142 in FIGS. 5 and 16 from its engaged position into its disengaged position. The pivoting movement of the trip latch 158 is imparted by the trip lever 144 by pivoting the trip lever 144 about the pin 160 and its axis 162 in the same counterclockwise direction as indicated by the arrow 170 in FIG. 16. The trip latch 148 has side extensions 172, 174 which define shoulders 176, 178, respectively, which confront shoulders 180, 182 on the trip lever legs 150, 152, respectively. The shoulders 180, 182 on the trip lever 144 drive the shoulders 176, 178 to pivot the trip latch 158 as the trip lever 144 is pivoted by the operator. The trip lever 144 and trip latch 158 could actually be formed to move as one piece to perform the function stated.

The trip lever 144, in this particular embodiment, is mounted so as to be operable by a squeezing force. More particularly, the operating portion 148 of the trip lever 144 is associated with a hollow, tubular, graspable handle 184 so that the handle 184 can be surrounded by a hand in such a manner as to permit grasping by the operator's fingers of the operating part 148 of the trip lever 144 and simultaneously the repositioning of the movable closure element 12 through the handle 184. The trip lever 144 is slid into a slot 186, originating at one end 188 of the handle 184. The slot 186 has a width W that is slightly greater than the width W1 of the operating part 148 of the trip lever 144. The slot length L is chosen so that the free end 190 of the trip lever 144, remote from the mounting legs 150, 152, can pass through the slot 186 as the trip lever 144 is pivoted in operation.

The trip lever 144 has oppositely projecting tabs 192 (one shown). The trip lever 144 is directed into the slot 186 so that the tabs 192 reside within the hollow 194 of the tubular handle 184. The tabs 192 effectively increase the width of the trip lever 144 thereat to a dimension that is greater than the width W. Accordingly, the trip lever 144 must be slid into the hollow 194 of the tubular handle 184 leading with the free end 190. The tabs 192 confine outward pivoting of the trip lever 144 relative to the handle 184.

A leaf spring 196 (FIG. 15) acts between the trip lever 144 and the inside surface 198 of the tubular handle 184 to normally urge the operating portion 148 of the trip lever 144 out of the slot 186 into a normal position. With the user grasping the tubular handle 184 in the vicinity of the trip lever 144, the fingers can be wrapped around the exposed edge 200 of the trip lever 144 and drawn towards the palm in a squeezing action to move the trip lever 144 from a normal position into a release position, as shown in phantom lines in FIG. 15 corresponding to normal and release states for the first actuating assembly 18. The shoulder 164 moves a first actuating distance in changing between the normal state and the release state. As the trip lever 144 is moved from the normal position into the release position, the trip latch 158 is pivoted in turn to move the catch block assembly 56 from its engaged position into its disengaged position an engagement distance. As seen in FIG. 16, because the shoulder 164 is contacting the catch block assembly 56, the engagement distance is substantially equal to the actuating distance.

The tubular handle 184 is maintained in its operative position by directing a mounting bolt 202 through a bore 204 in a flange 206 on the mounting plate 146 and into a threaded receptacle 208 on a U-shaped spring clip 210 and which is maintained within the hollow 194 by sliding the U-shaped spring clip 210 over the tubular handle end 188.

The opposite end 212 of the tubular handle 184 is mounted to the closure element 12 through an elbow-shaped fitting 214. The fitting 214 has a male end portion 216 which fits slidably within the hollow 194 at the handle end 212. An annular shoulder 218 abuts to the handle end 212 with the fitting 214 fully seated. The fitting 214 has a flange 220 which seats on one side 222 of the movable closure element 12 and has a threaded bore 224 to accept a mounting bolt 226.

A protective shroud 228, made of plastic, or the like, can be slid over the housing 20 and the components mounted thereto, i.e. the latching subassembly 143, the mounting plate 146, the trip latch 158, and the adjacent portions of the tubular handle 184 and trip lever 144. The shroud 228 has a slot 230 to accept the tubular handle 184 and an opening 232 through which the rotors 30, 32 are exposed to permit engagement with the strike element 16. The shroud 28 is maintained in its operative position by connection to the mounting plate 146 through screws 234.

Figure 8:
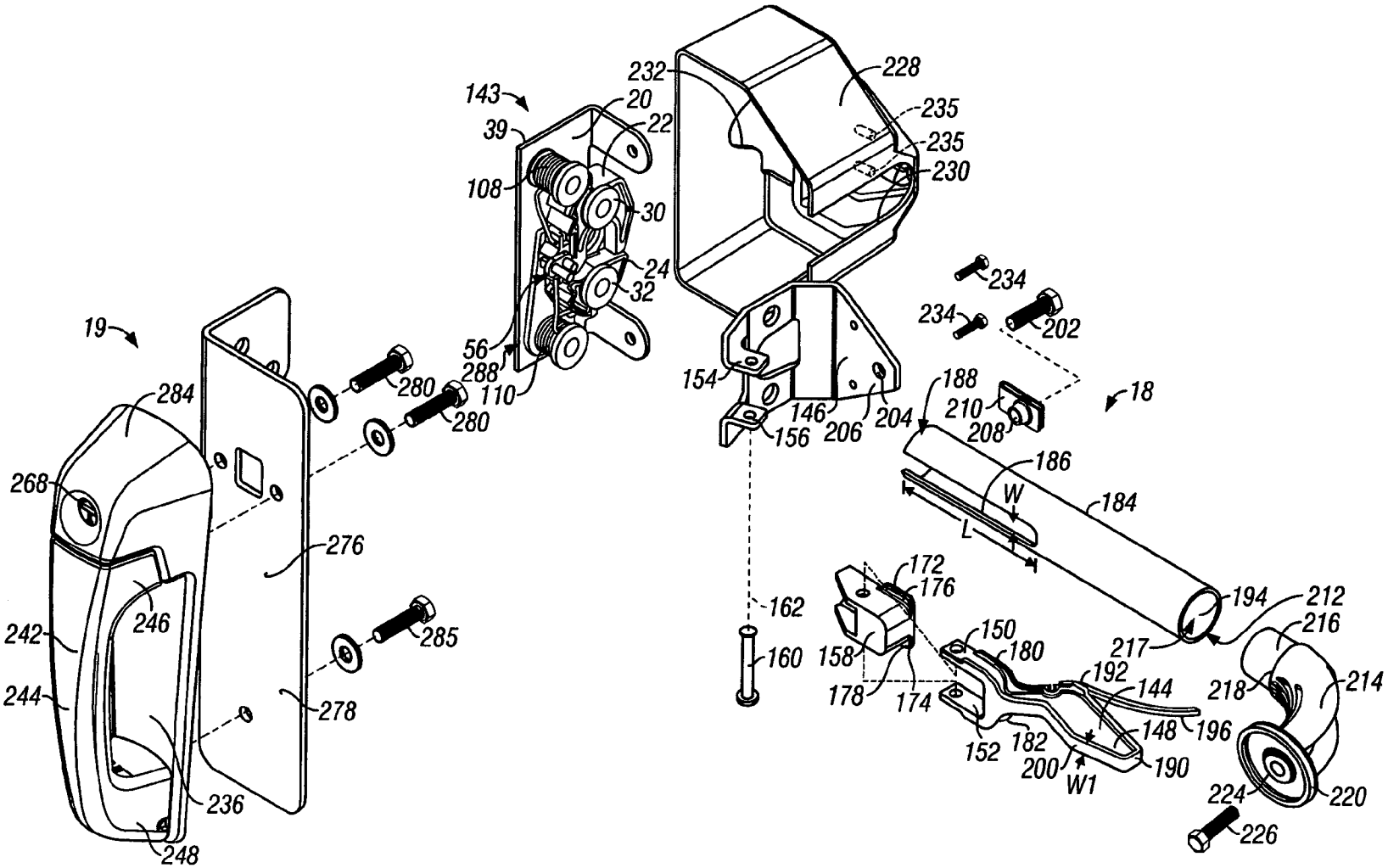
FIG. 8 is an exploded, perspective view of the inventive latch assembly including the latching subassembly and first and second actuating assemblies for operating the latching subassembly.
Figure 9:
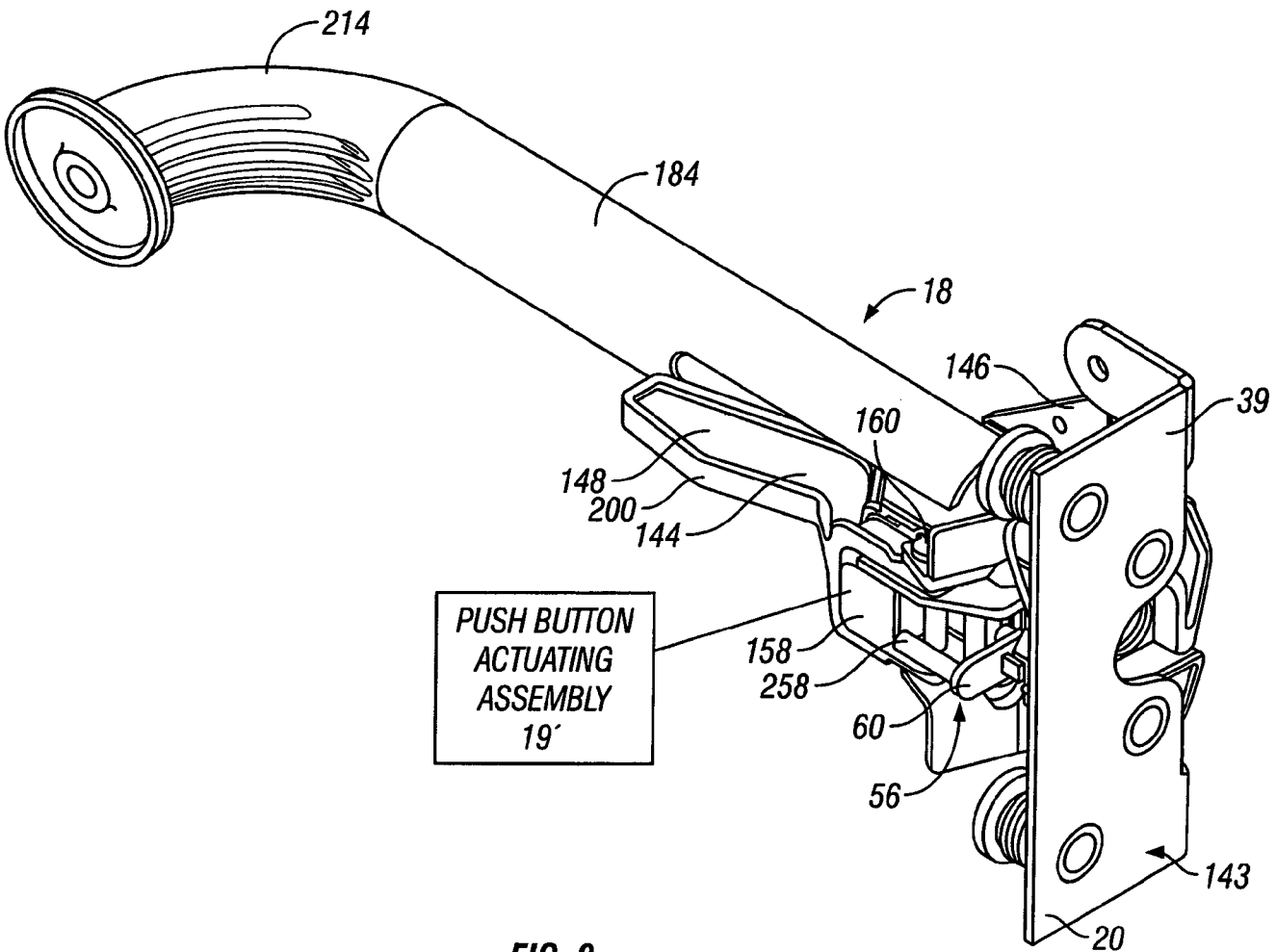
FIG. 9 is a rear perspective view of a combined subassembly including a first of the actuating assemblies in FIG. 8 and the latching subassembly in FIGS. 3–7.
Figure 10:
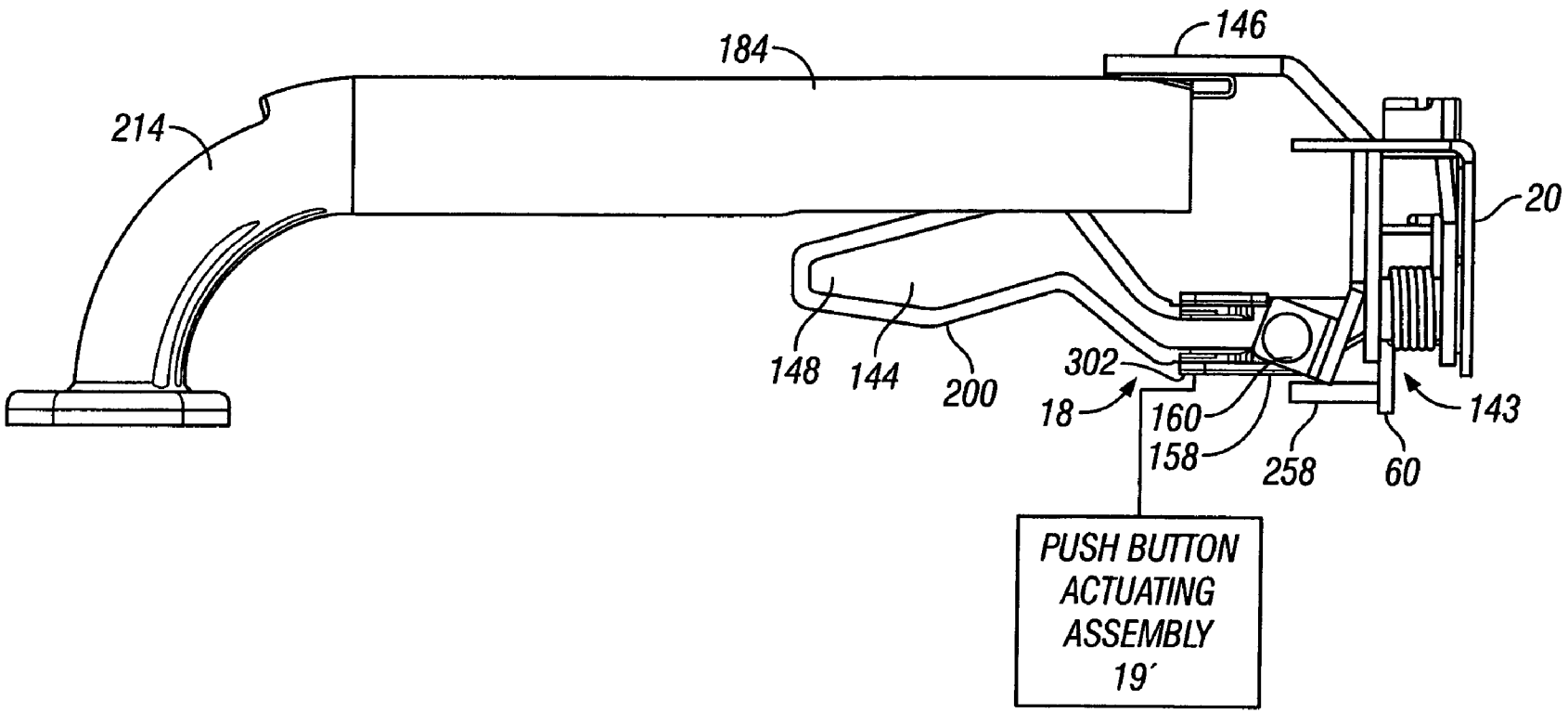
FIG. 10 is a plan view of the combined subassembly of FIG. 9.
Figure 11:
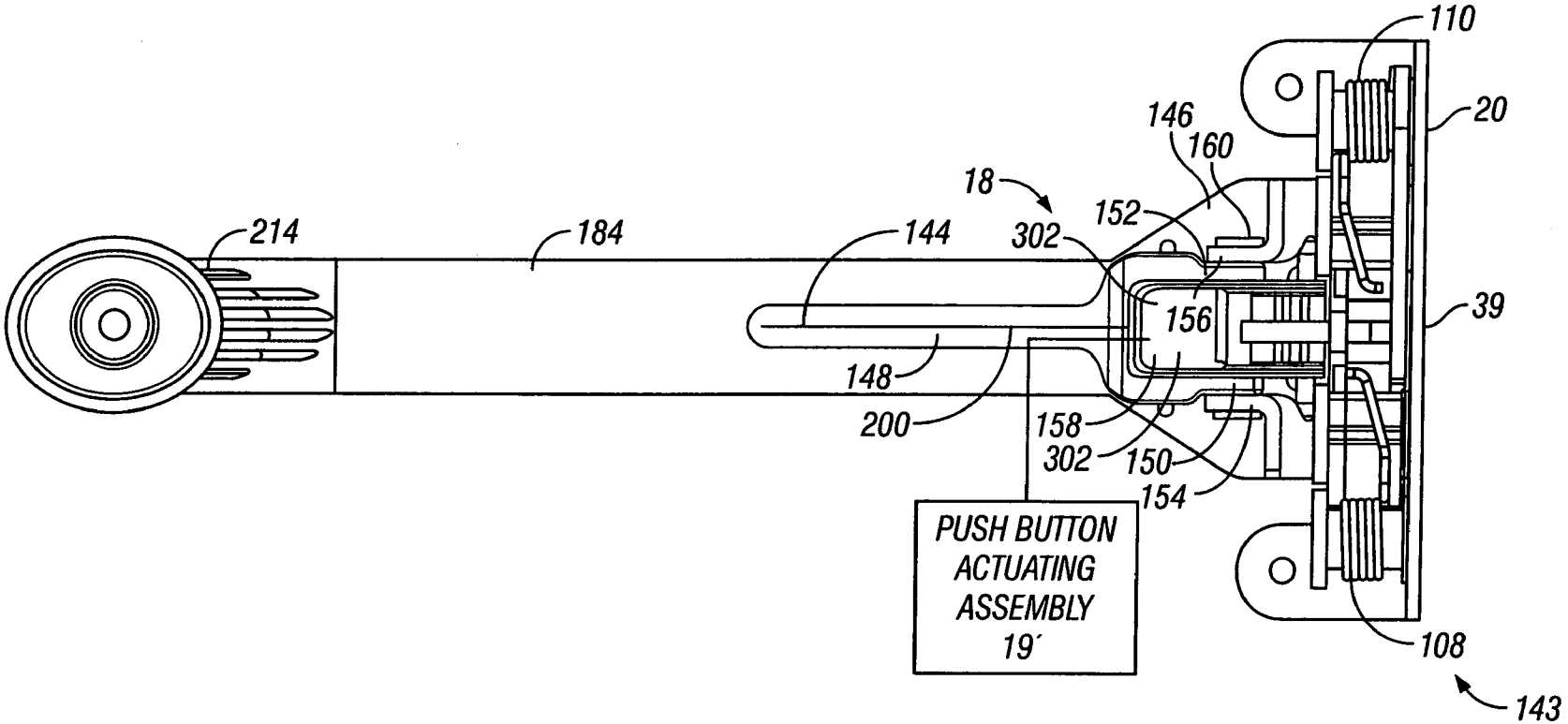
FIG. 11 is a front elevation view of the combined subassembly of FIGS. 9 and 10.
Figure 12:
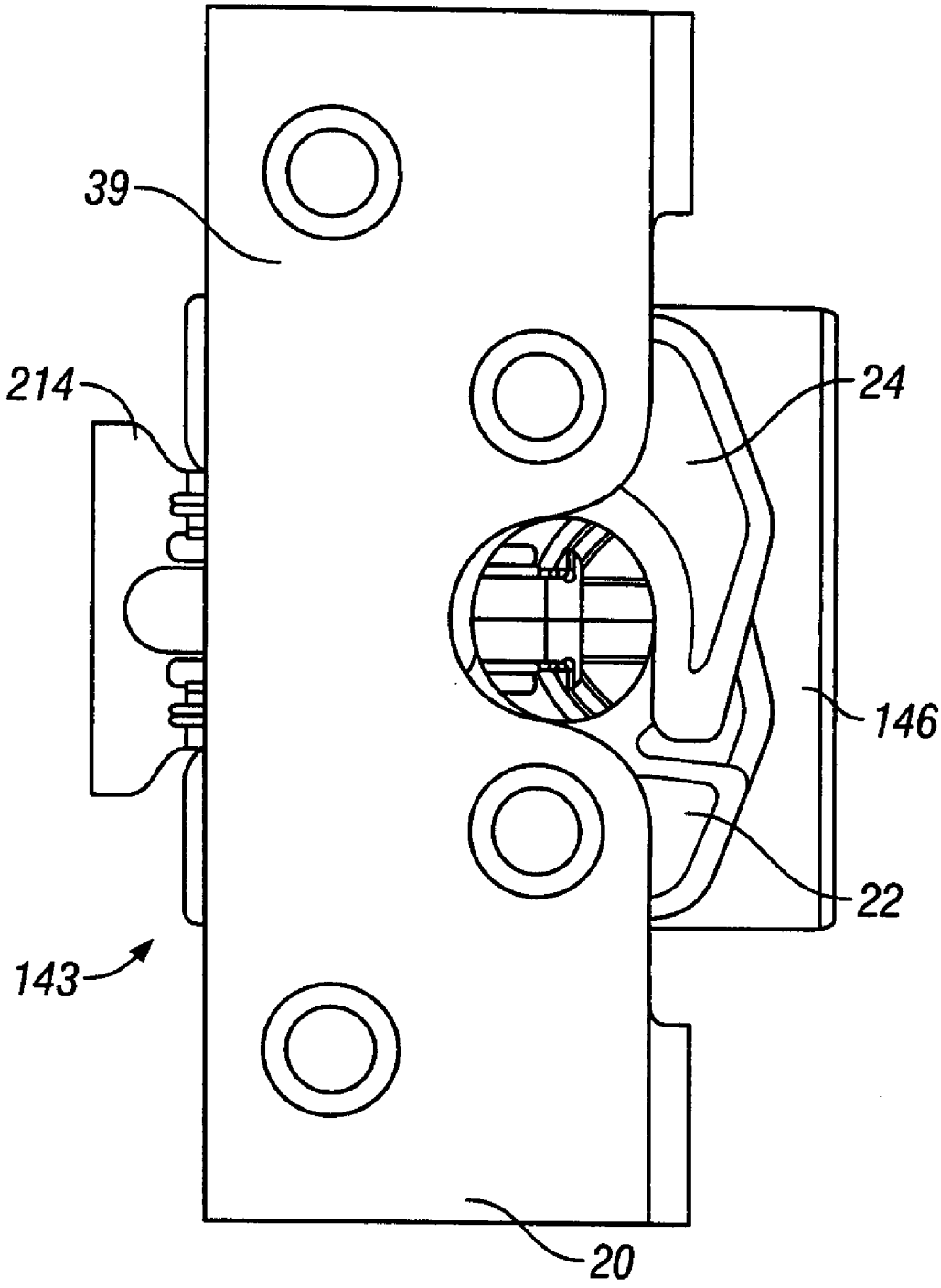
FIG. 12 is an side elevation view of the combined subassembly of FIGS. 9–11.
Figure 13:
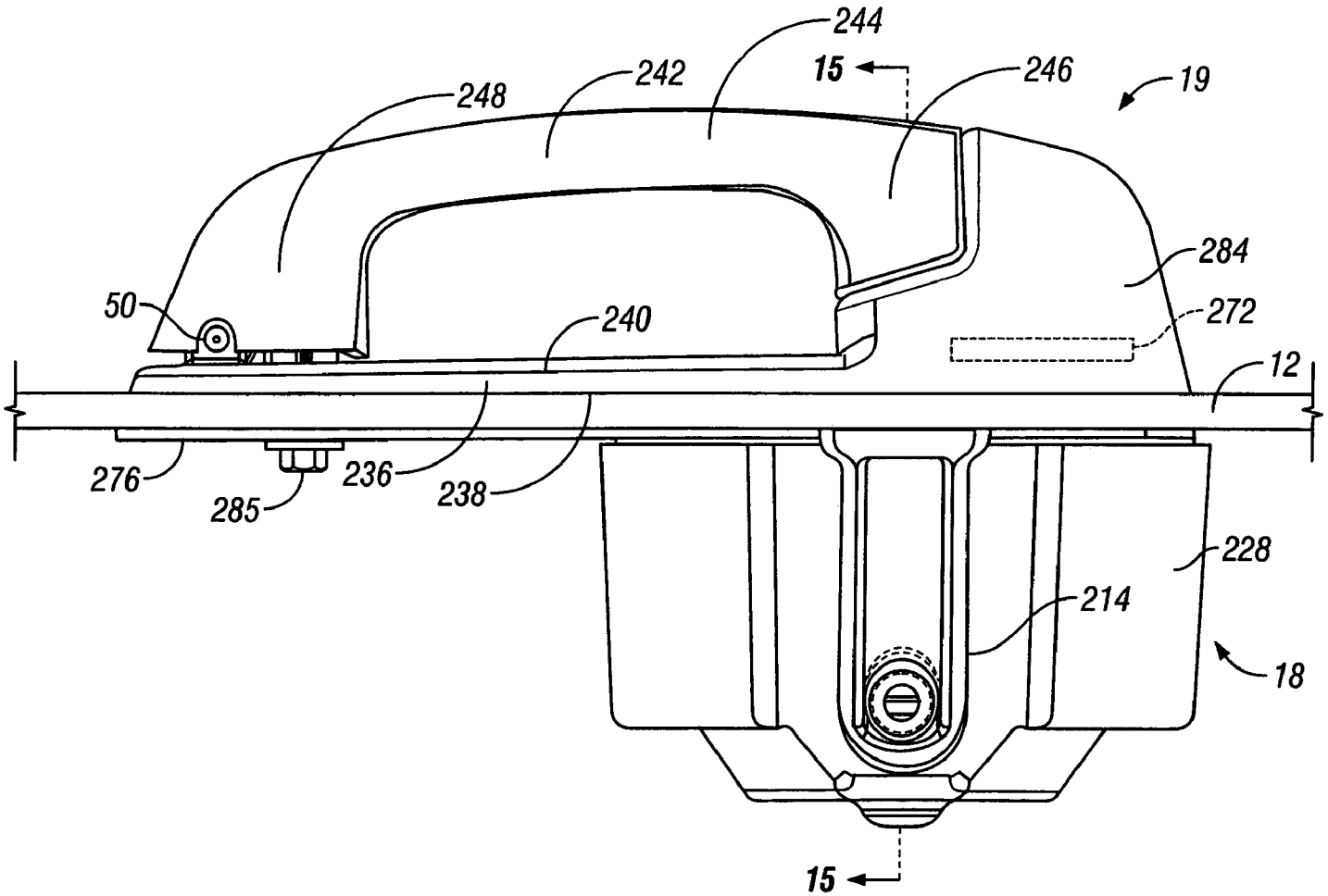
FIG. 13 is a side elevation view of the inventive latch assembly assembled to a section of a movable closure element and with a protective shroud placed over the combined subassembly of FIGS. 9–12.
Figure 15:
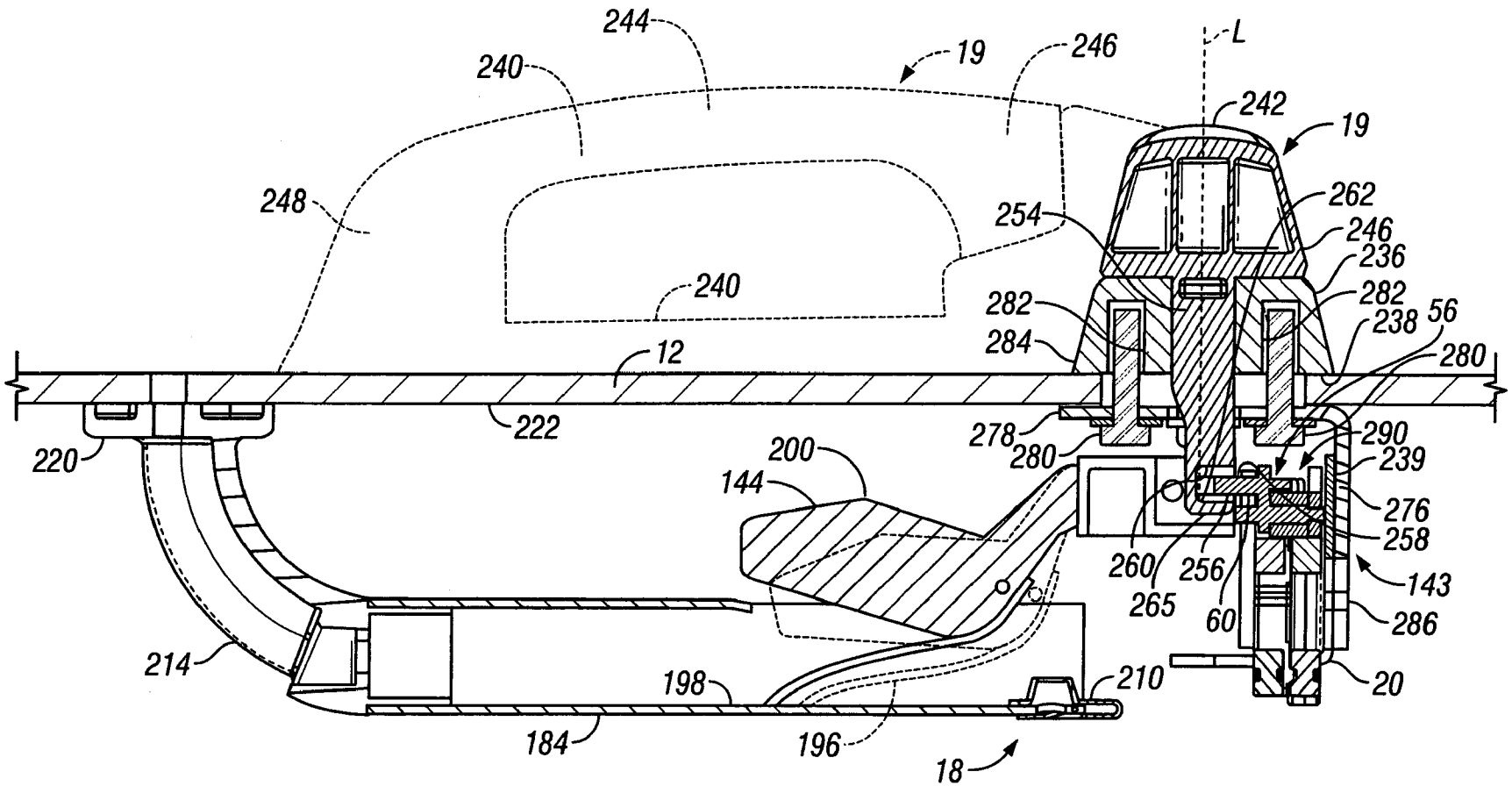
FIG. 15 is a cross-sectional view of the latch assembly taken along line 15—15 of FIG. 13 with the protective shroud removed from the combined subassembly and with one of the actuating subassemblies shown in an alternative mounting orientation in dotted lines.
Figure 16:
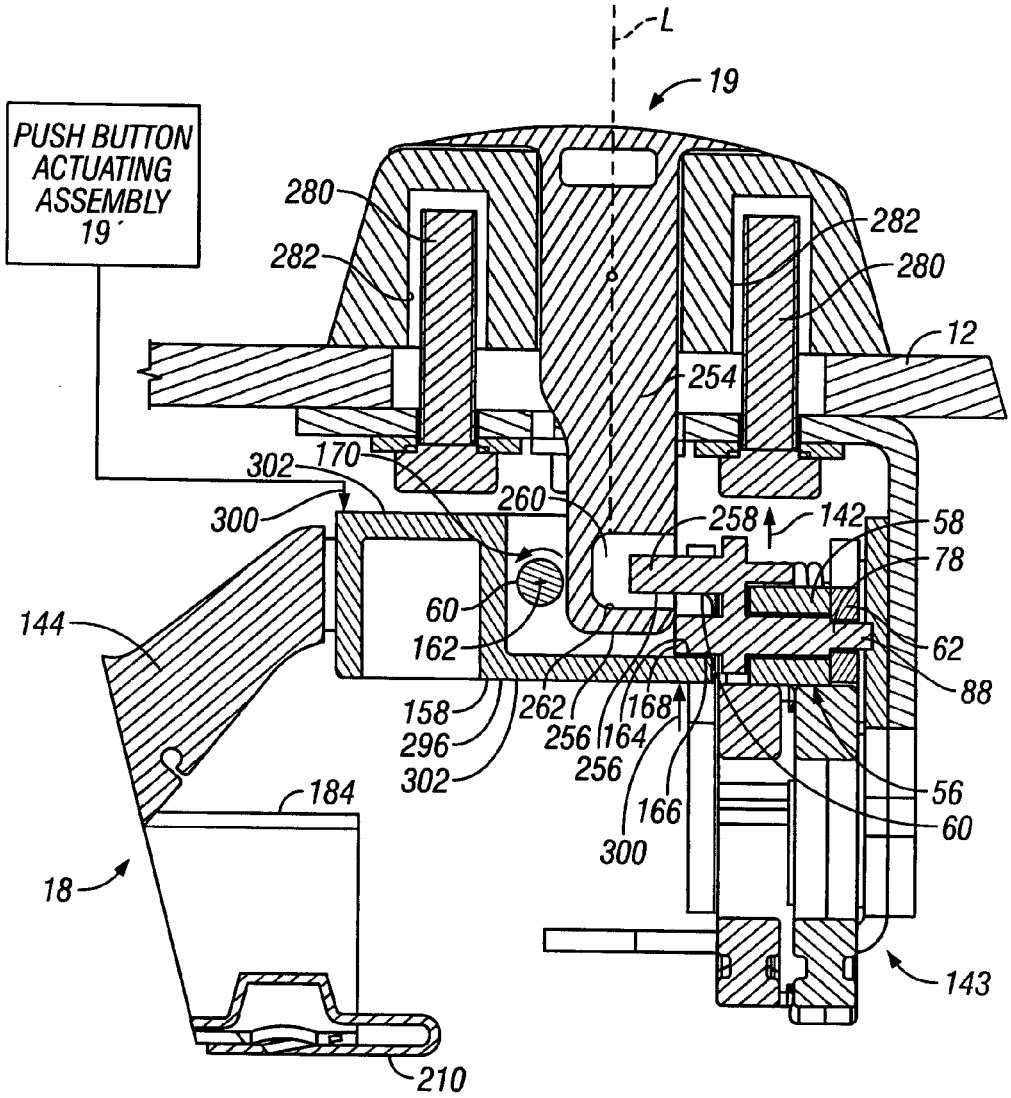
FIG. 16 is an enlarged, fragmentary view of a portion of the latch assembly as shown in cross-section in FIG. 15.
Figure 17:
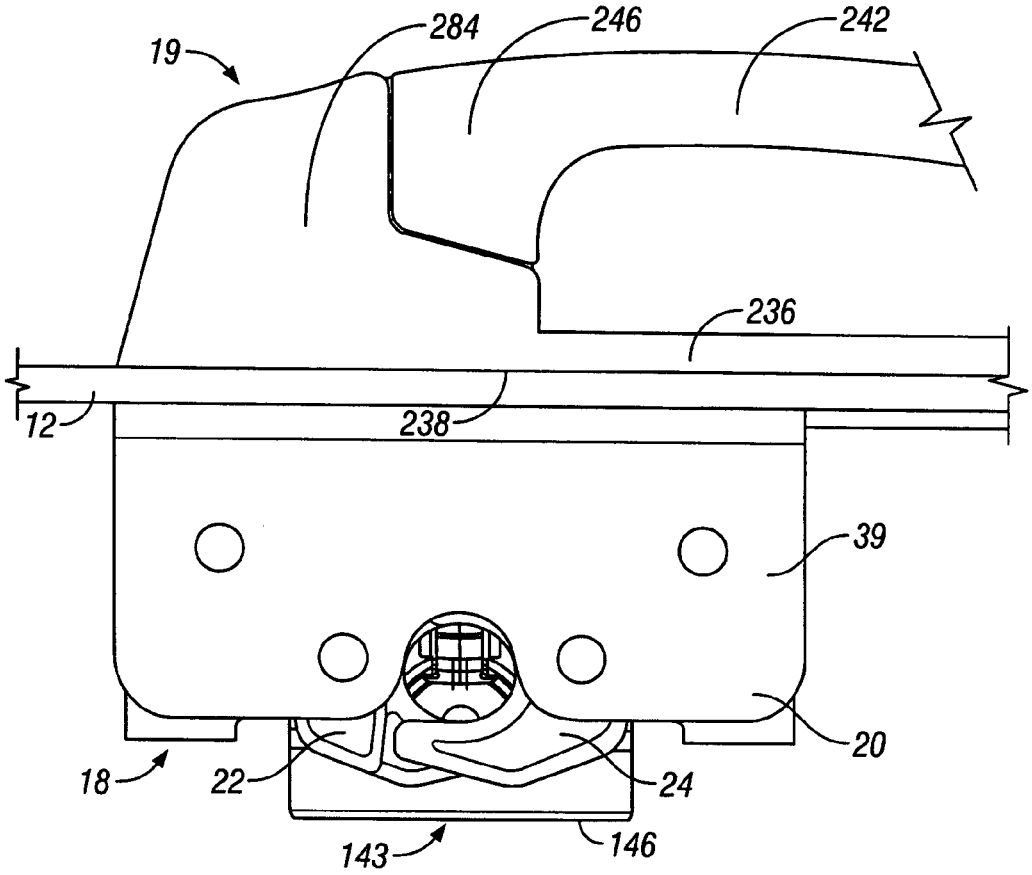
FIG. 17 is a fragmentary, side elevation view of the latch assembly in FIGS. 13–16.
Figure 18:
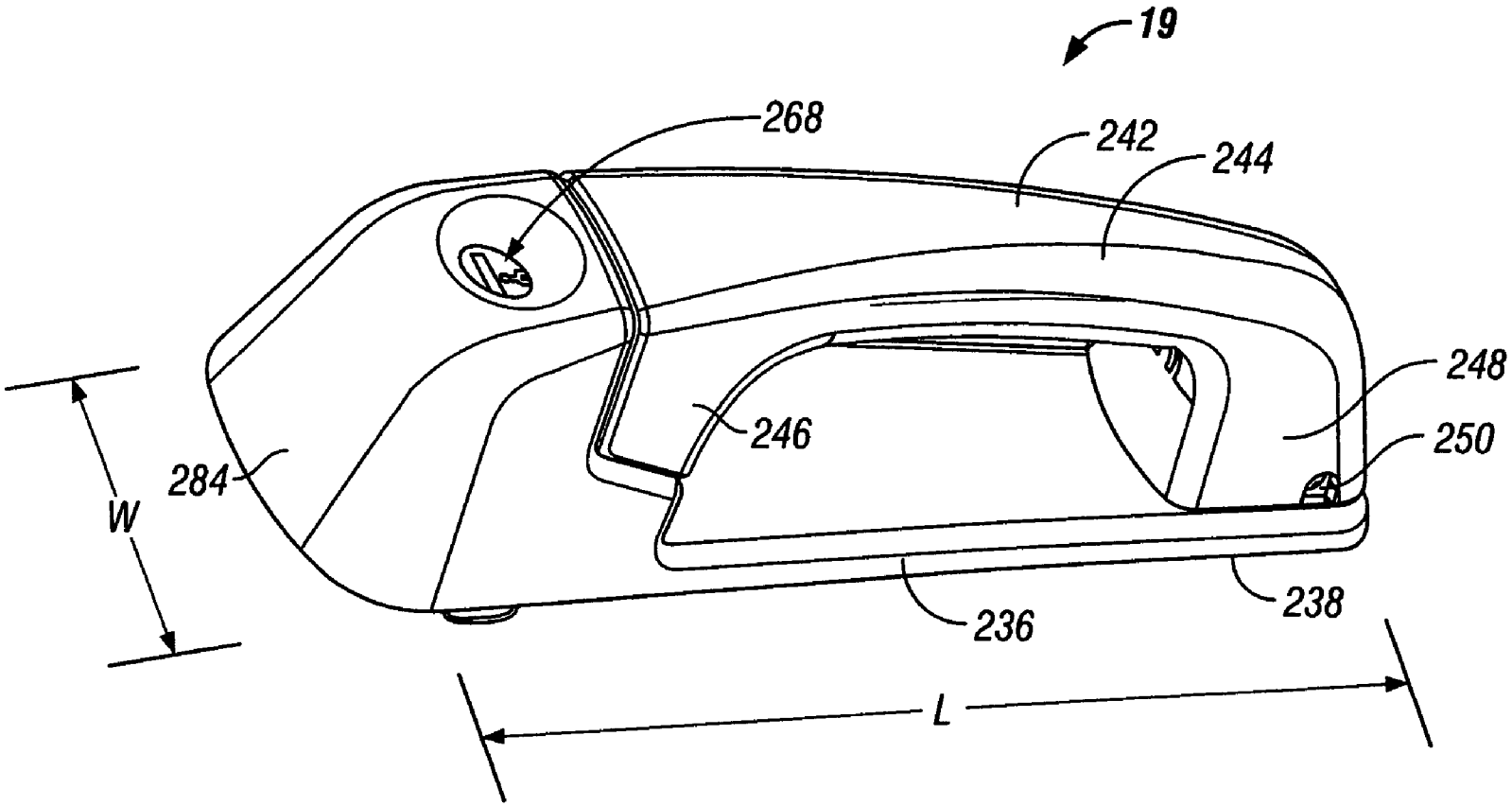
FIG. 18 is a perspective view of a second actuating assembly for placement on the side of a movable closure element opposite that to which the first latch assembly shown in FIGS. 9–12 is located with one form of locking assembly.
Figure 19:
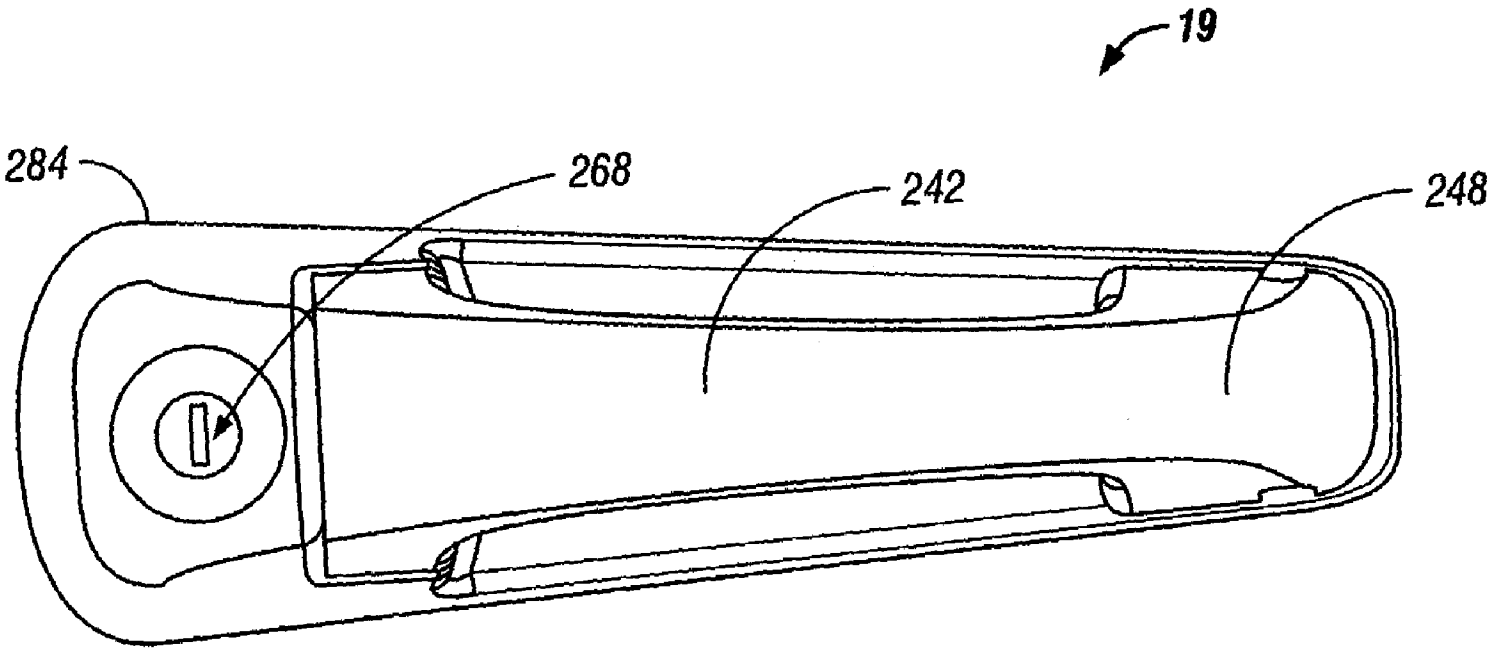
FIG. 19 is a front elevation view of the second actuating assembly in FIG. 18.

Details of the second actuating assembly 19 are shown in FIGS. 8, 13, and 15. The second actuating assembly 19 consists of a mounting base 236 defining a flat mounting surface 238 which can be facially placed against the flat, second side 240 of the movable closure element 12. The mounting surface 238 extends over substantially the entire length (L) and width (W) dimension of the mounting base 236. An actuating handle 242 is pivotably attached to the base 236. The actuating handle 242 is U-shaped with a graspable base 244 and spaced first and second legs 246,248. The leg 248 is pivotably connected to the base 236 through a pin 250 for pivoting movement around an axis 252. Through a spring assembly 253, the actuating handle 242 is urged towards its normal position, as seen in solid lines in each of FIGS. 13, 15 and 17–22. More preferably, once the actuating handle 242 is operated, the biased catch block 58 loads the springs 108, 110 so that the springs 108, 110 urge the catch block 58 in a manner that causes the actuating handle 242 to be moved back towards its normal position, once the actuating force thereon is released. This obviates the need for the spring assembly 253.

The leg 246 has a projecting element/cantilevered connecting element 254 which moves as one piece with the leg 246. The projecting element/cantilevered connecting element 254 projects past the mounting surface 238 and is configured to engage a surface 256 defined by a cantilevered post 258 on the adaptor 60 on the catch block assembly 56. The post 258 is spaced from, and longer than, the post 168.

The projecting element/cantilevered connecting element 254 directly engages the post 258. The projecting element/cantilevered connecting element 254 has an opening 260 formed therein into which the post 258 projects with the second actuating assembly 19 in operative position.

Figure 20:
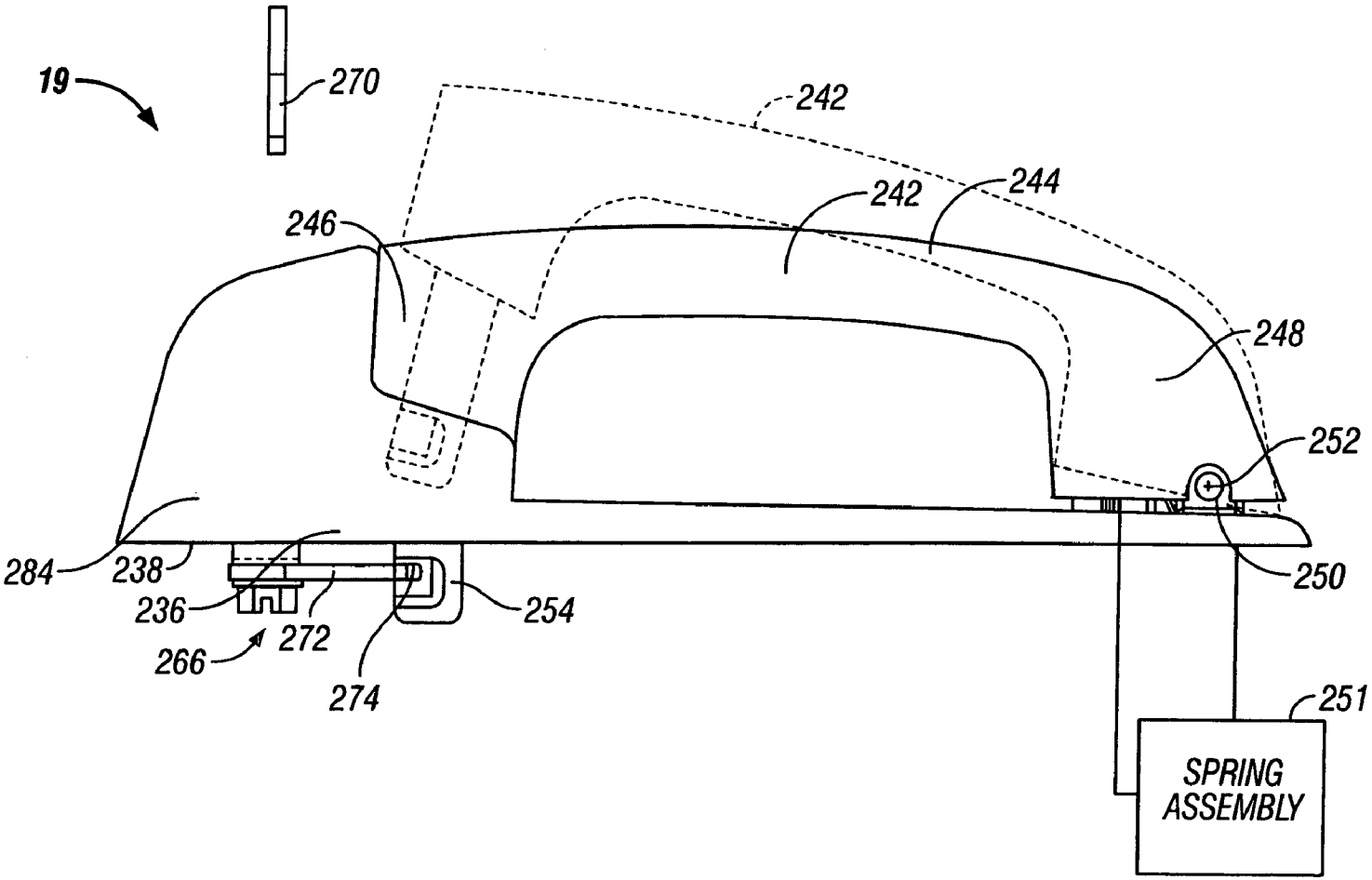
FIG. 20 is a plan view of the second actuating assembly in FIGS. 18 and 19.
Figure 21:
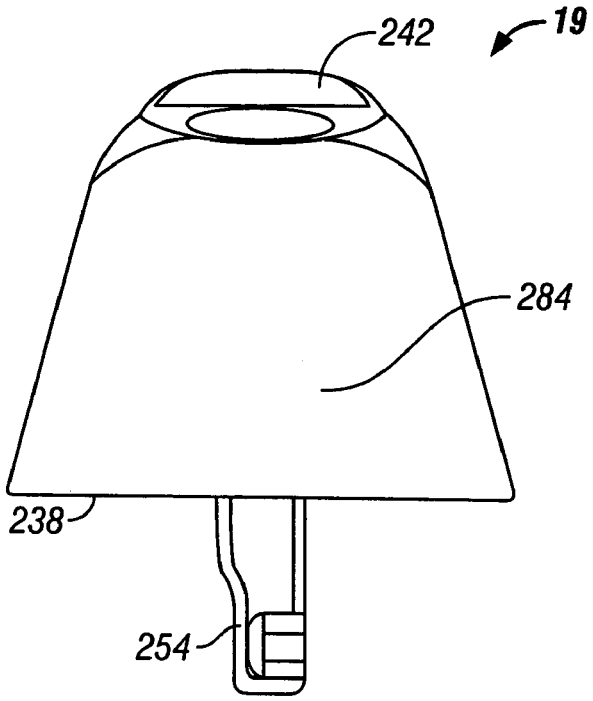
FIG. 21 is a side elevation view of the second actuating assembly in FIGS. 18–20.
Figure 22:
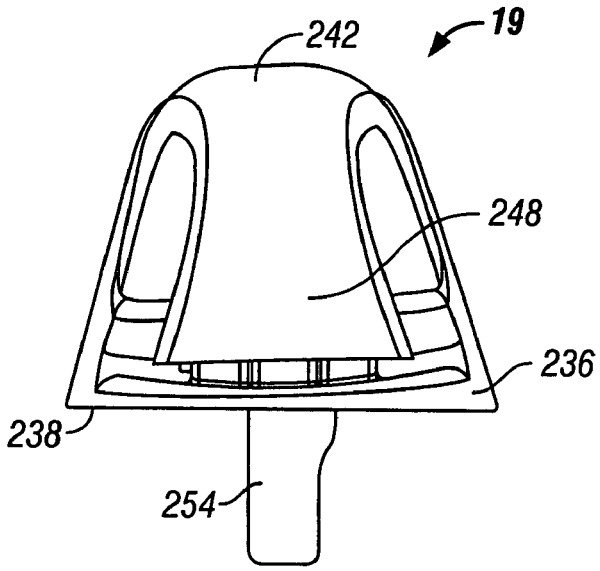
FIG. 22 is an elevation view of the second actuating assembly in FIGS. 18–21 from the side opposite that in FIG. 21.

The actuating handle 242 is changeable between the normal position, shown in FIGS. 13, 15, and 17–22, and a release position, as shown in phantom in FIG. 20 to change the second actuating assembly 19 from a normal state into a release state. As the actuating handle 242 is changed from the normal position into the release position, the shoulder 262 bounding the opening 260 in the projecting element/cantilevered connecting element 254, moves substantially parallel to the first line, as indicated by the arrow 142, and bears directly upon the post 258, thereby drawing the catch block assembly 56 in the direction of the arrow 142 so as to thereby change the catch block assembly 56 from its engaged position into its disengaged position. The opening 260 is configured so that the post 258 can be directed thereinto to coact with the shoulder 262 with the first and second actuating assemblies 18, 19 in a range of relative positions without the need for separate fasteners acting between the post 258 and projecting element/cantilevered projecting element 254. More specifically, the first and second actuating assemblies 18, 19 can be relatively repositioned about a line L through the length of the projecting element/cantilevered projecting element 254 through a range of preferably at least 90°. This allows the length of the actuating handle 242 to be oriented selectively horizontally and vertically. This is made possible by forming the opening 262 by cutting out the projecting element/cantilevered connecting element 254 over a substantial portion of its periphery yet while maintaining he free end 265 defining the shoulder 262 rigidly upon the projecting element/cantilevered connecting element 254.

The second actuating assembly 19 has a lock assembly at 266 which has a key operated cylinder 268. By directing a key 270 into the cylinder 268, the cylinder 268 can be rotated to reposition a locking tab 272 between locked and unlocked states. In the locked state, the locking tab 272 is directed into a slot 274 in the projecting element/cantilevered connecting element 254 so as to prevent pivoting of the handle 242 as to draw the projecting element/cantilevered connecting element 254 along the line L to resituate the catch block assembly 56 in the disengaged position.

Figure 14:
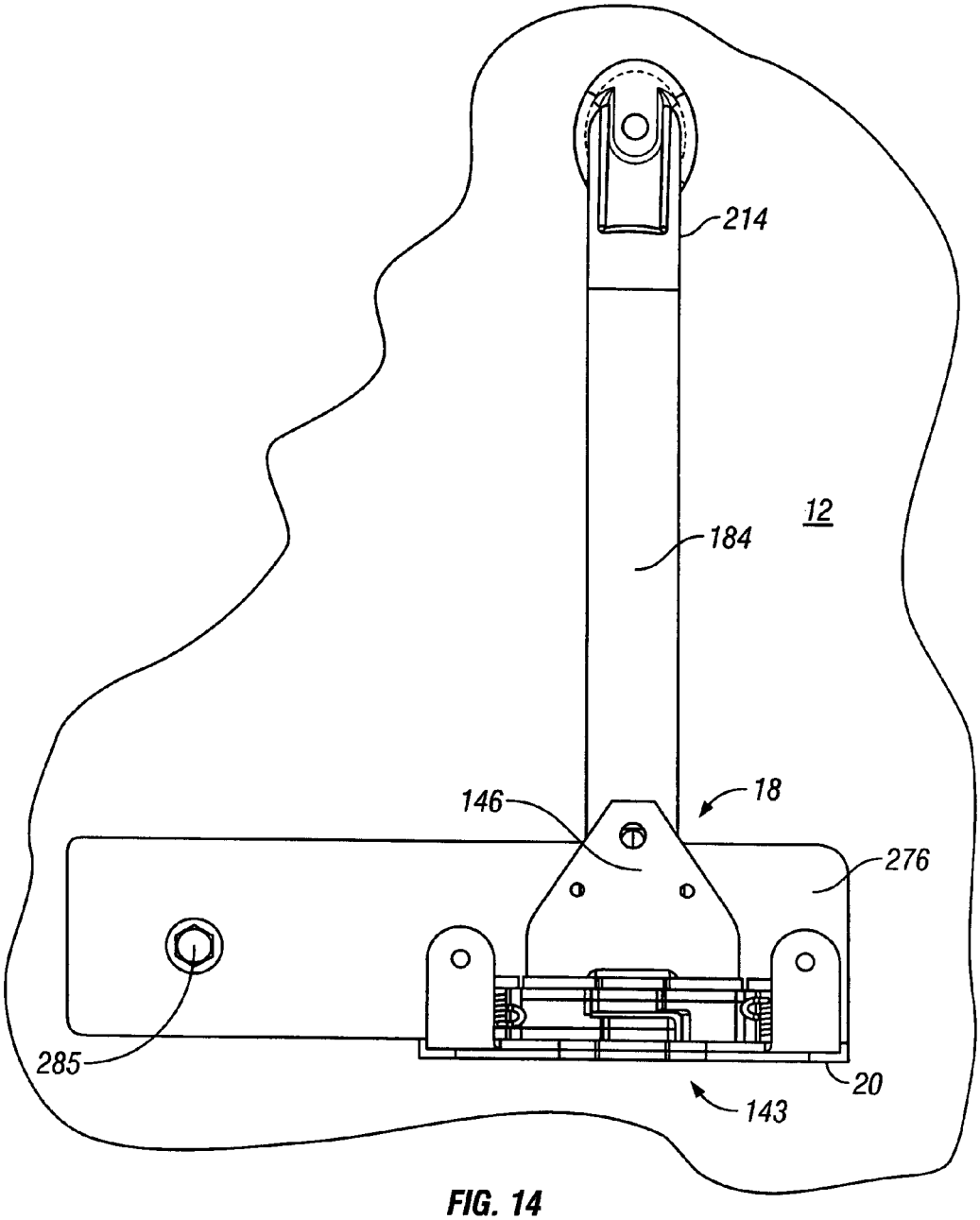
FIG. 14 is a rear elevation view of the combined subassembly in FIGS. 9–12 attached to a section of a movable closure element and with the protective shroud removed.

The first and second actuating assemblies 18, 19 and movable closure element 12 are interconnected through an angled mounting plate 276, as see in FIGS. 8, 14, and 15. The mounting plate 276 has a flat wall 278 which abuts to the movable closure element 12. Mounting bolts 280 are directed through the wall 278 and the movable closure element 12 and into threaded receptacles 282 in an enlarged portion 284 of the mounting base 236. A mounting bolt 285 extends through the mounting plate 276, the movable closure element 12, and into the mounting base 236.

A flat wall 286, orthogonal to the flat wall 278 on the mounting plate 276, is secured to the flat side 239 of the housing 20, either using separate bolts directed through prethreaded bores in the axles 30, 32, 74, 134, or by extending the axles 30, 32, 74, 134 therethrough and conforming the axles 30, 32, 74, 134 therearound. This mounting arrangement creates a space at 290 on the side of the movable closure element 12 at which the first actuating assembly 18 is mounted within which the locking tab 272 can move.

Figure 23:
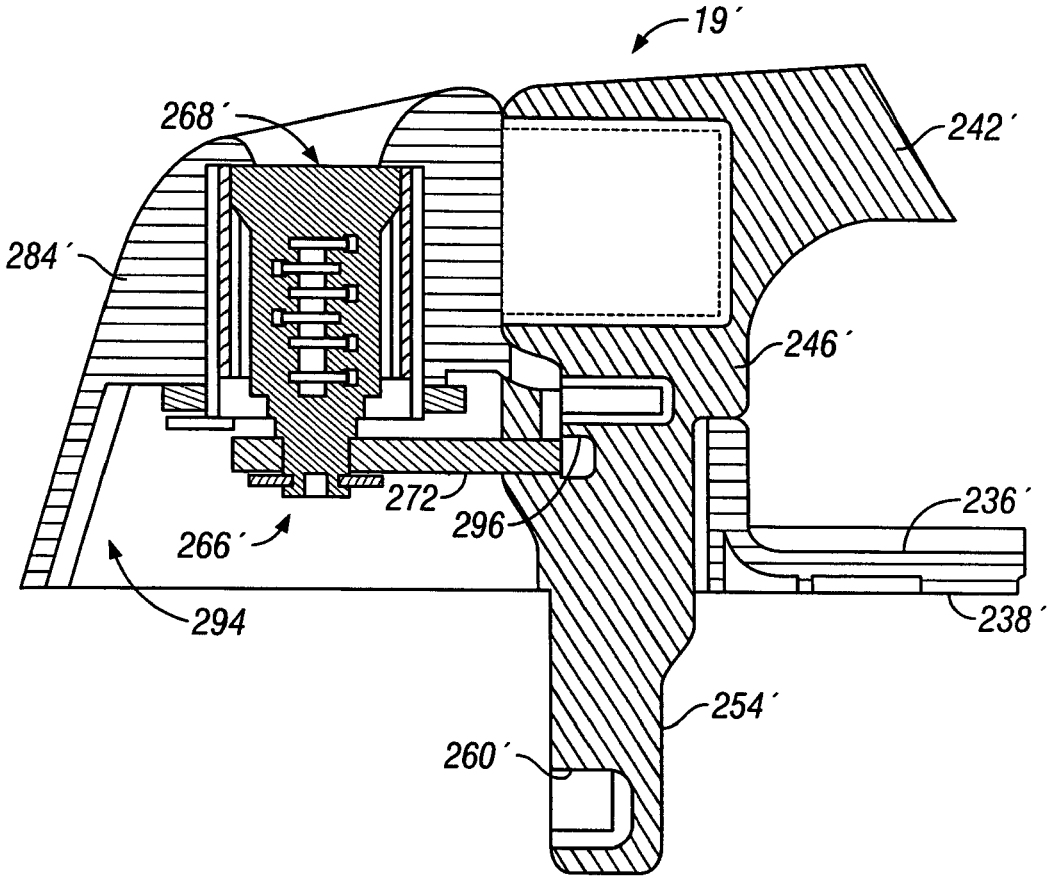
FIG. 23 is a fragmentary, cross-sectional view of a modified form of second actuating assembly with a modified form of locking assembly.

Alternatively, as shown in FIG. 23, the locking tab 272 can be mounted in a recess 294 on a modified form of a second actuating assembly 19', similar to the second actuating assembly 19, and having corresponding parts identified with a "'". The second actuating assembly 19' has a mounting base with a flat mounting surface 238' and an actuating handle 242' pivotably attached to the base 236'. The actuating handle 242' has a leg 246' with a projecting element/cantilevered connecting element 254' with an opening 260' to receive the post 258. The actuating handle has a slot 296 to receive the locking tab in the locked state therefor, as shown in FIG. 23. By rotating a cylinder 268', the tab 272 can be pivoted to an unlocked state, wherein the tab 272 resides outside of the slot 270 so as not to inhibit movement of the actuating handle 242'. This embodiment affords a compact lock assembly 266' within the recess 294 in an enlarged portion 284' of the base 236'. As seen in FIGS. 9–11 and 16, the configuration of the trip latch 158 is such that it is pivotable independently of the trip lever 144 around the pin axis 162 to cause the catch assembly 56 to be moved from the engaged position by applying a force in the direction of the arrow 300 on the surface 302 to the left of the pivot axis 162 in FIG. 16. This force can be imparted by a push button actuating assembly 19' that can be used in place of the actuating assembly 19 on the door 12. The push button actuating assembly 18' has an actuator element 304 that is translatable substantially in a line between normal and release positions. In moving from the normal position to the release position, the actuating element 304 imparts an actuating force to the surface 302.

The foregoing disclosure of specific embodiments is intended to be illustrative of the broad concepts comprehended by the invention.

The invention claimed is:

1. A latch assembly for a movable closure element having first and second sides, the latch assembly comprising:

a housing, a first rotor movable relative to the housing selectively between a) a latched position and b) a release position, the first rotor engageable with a strike element relative to which the movable closure element can be moved to thereby releasably maintain the movable closure element in a desired position, the first rotor biased towards the release position; and an operating assembly which is operable to change the first rotor from the latched position into the release position, the operating assembly comprising a catch block assembly that is movable selectively between a) an engaged position wherein the catch block assembly engages the first rotor to thereby maintain the first rotor in the latched position and b) a disengaged position wherein the first rotor is permitted to move from the latched position into the release position, the catch block assembly comprising a portion that moves as one piece substantially along a first line and acts against the first rotor as the catch block assembly is changed from the engaged position into the disengaged position, the operating assembly further comprising a first actuating assembly for mounting on the first side of the movable closure element, the first actuating assembly having a first normal state and a first release state the first actuating assembly having a first element directly engaging the portion of the catch block assembly, moving substantially parallel to the first line, and causing the catch block assembly to change from the engaged position into the disengaged position as an incident of the first actuating assembly changing from the first normal state into the first release state, the operating assembly further comprising a second actuating assembly for mounting on the second side of the movable closure element, the second actuating assembly having a second normal state and a second release state, the second actuating assembly having a second element separate from the first element directly engaging the portion of the catch block assembly, moving substantially parallel to the first line, and causing the catch block assembly to change from the engaged position into the disengaged position as an incident of the second actuating assembly changing from the second normal state into the second release state, the portion of the catch block assembly acting against the first rotor to maintain the first rotor in its latched position with the catch block assembly in the engaged position.

2. The latch assembly for a movable closure element according to claim 1 wherein the housing, first rotor, catch block assembly and first actuating assembly define a first subassembly that is selectively separable and operably connectable as a unit to the second actuating assembly.

3. The latch assembly for a movable closure element according to claim 1 wherein the first rotor is movable between the latched position and release position around a first axis.

4. The latch assembly for a movable closure element according to claim 1 further comprising a second rotor that is movable relative to the housing between a latched position and a release position, the first and second rotors each having a throat to receive a strike element and configured so that the first and second rotors cooperatively captively engage a strike element with the first and second rotors in their latched positions.

5. The latch assembly for a movable closure element according to claim 1 wherein the first actuating assembly comprises a base which defines the mounting surface and a first actuating handle which is pivotably attached to the base for movement about a first axis between normal and release positions.

6. The latch assembly for a movable closure element according to claim 1 further in combination with a movable closure element having first and second sides.

7. The latch assembly for a movable closure element according to claim 1 further in combination with a movable closure element having first and second sides, one of the first and second sides defined by a flat surface to which one of the first and second actuating assemblies is mounted and the first line is substantially perpendicular to a plane containing the flat surface.

8. The latch assembly for a movable closure element according to claim 1 wherein the first line is substantially straight.

9. A latch assembly for a movable closure element having first and second sides, the latch assembly comprising:

a housing, a first rotor movable relative to the housing selectively between a) a latched position and b) a release position, the first rotor engageable with a strike element relative to which the movable closure element can be moved to thereby releasably maintain the movable closure element in a desired position, the first rotor biased towards the release position; and an operating assembly which is operable to change the first rotor from the latched position into the release position, the operating assembly comprising a catch block assembly that is movable selectively between a) an engaged position wherein the first rotor is maintained in the latched position and b) a disengaged position wherein the rotor is permitted to move from the latched position into the release position, the catch block assembly comprising a portion that moves as one piece substantially along a first line as the catch block assembly is changed from the engaged position into the disengaged position, the operating assembly further comprising a first actuating assembly for mounting on the first side of the movable closure, the first actuating assembly having a first normal state and a first release state, the first actuating assembly having a first element directly engaging the catch block assembly, moving substantially parallel to the first line, and causing the catch block assembly to change from the engaged position into the disengaged position as an incident of the first actuating assembly changing from the first normal state into the first release state, the operating assembly further comprising a second actuating assembly for mounting on the second side of the movable closure element, the second actuating assembly having a second normal state and a second release state, the second actuating assembly having a second element separate from the first element directly engaging the portion of the catch block assembly, moving substantially parallel to the first line, and causing the catch block assembly to change from the engaged position into the disengaged position as an incident of the second actuating assembly changing from the second normal state into the second release state, the portion of the catch block assembly acting against the first rotor to maintain the first rotor in its latched position with the catch block assembly in the engaged position, wherein the first rotor is movable between the latched position and release position around a first axis, wherein the operating assembly comprises a catch arm that is pivotable relative to the housing about a second axis between first and second positions and the catch block assembly is mounted to the catch arm and is movable pivotably relative to the catch arm around a third axis.

10. The latch assembly for a movable closure element according to claim 9 wherein the first, second, and third axes are substantially parallel to each other.

11. The latch assembly for a movable closure element according to claim 9 wherein the catch block assembly comprise a catch block and an adaptor attached to the catch block, the adaptor securing the catch block to the catch arm and defining a first surface that is directly engaged by the first element on the first actuating assembly.

12. The latch assembly for a movable closure element according to claim 11 wherein the catch block and adaptor are movable as one piece substantially parallel to the first line as the catch block assembly moves between the engaged and disengaged positions.

13. The latch assembly for a movable closure element according to claim 11 wherein the first surface is defined by a cantilevered first post projecting substantially orthogonally to the first line.

14. The latch assembly for a movable closure element according to claim 13 wherein the catch block assembly defines a second surface that is directly engaged by the second element and the second surface is defined by a second cantilevered post that is spaced from the first cantilevered post and projects substantially orthogonally to the first line.

15. A latch assembly for a movable closure element having first and second sides, the latch assembly comprising:

a housing, a first rotor movable relative to the housing selectively between a) a latched position and b) a release position, the first rotor engageable with a strike element relative to which the movable closure element can be moved to thereby releasably maintain the movable closure element in a desired position, the first rotor biased towards the release position; and an operating assembly which is operable to change the first rotor from the latched position into the release position, the operating assembly comprising a catch block assembly that is movable selectively between a) an engaged position wherein the first rotor is maintained in the latched position and b) a disengaged position wherein the rotor is permitted to move from the latched position into the release position, the catch block assembly comprising a portion that moves as one piece substantially along a first line as the catch block assembly is changed from the engaged position into the disengaged position, the operating assembly further comprising a first actuating assembly for mounting on the first side of the movable closure, the first actuating assembly having a first normal state and a first release state, the first actuating assembly having a first element directly engaging the catch block assembly, moving substantially parallel to the first line, and causing the catch block assembly to change from the engaged position into the disengaged position as an incident of the first actuating assembly changing from the first normal state into the first release state, the operating assembly further comprising a second actuating assembly for mounting on the second side of the movable closure element, the second actuating assembly having a second normal state and a second release state, the second actuating assembly having a second element separate from the first element directly engaging the portion of the catch block assembly, moving substantially parallel to the first line, and causing the catch block assembly to change from the engaged position into the disengaged position as an incident of the second actuating assembly changing from the second normal state into the second release state, the portion of the catch block assembly acting against the first rotor to maintain the first rotor in its latched position with the catch block assembly in the engaged position, wherein the first actuating assembly comprises a flat mounting surface to abut to the first side of the movable closure element and a cantilevered connecting element which projects past the mounting surface and engages the catch block assembly.

16. The latch assembly for a movable closure element according to claim 15 wherein the first actuating assembly comprises a base which defines the mounting surface and a first actuating handle which is pivotably attached to the base for movement about a first axis between normal and release positions and the cantilevered connecting element is moved in a path as one piece with the first actuating handle transversely to the mounting surface as the first actuating handle is moved between its normal and release positions.

17. The latch assembly for a movable closure element according to claim 16 wherein the cantilevered connecting element has a length extending along a first line and a first reference plane containing the first line is substantially orthogonal to a second reference plane containing the first axis.

18. The latch assembly for a movable closure element according to claim 16 wherein the first actuating handle is U-shaped and defined by a graspable base and spaced first and second legs, the first leg is pivotably attached to the base, and the cantilevered connecting element is on the second leg.

19. The latch assembly for a movable closure element according to claim 18 wherein the cantilevered connecting element has an opening, the catch block assembly has a post, and the cantilevered connecting element is engaged with the catch block assembly by directing the post into the opening of the cantilevered connecting element without requiring any separate fasteners acting between the cantilevered connecting element and the post.

20. The latch assembly for a movable closure element according to claim 16 further comprising a locking assembly having a locked state and an unlocked state, the locking assembly in the latched state preventing movement of the first actuating handle from the normal position into the release position.

21. The latch assembly for a movable closure element according to claim 20 wherein the locking assembly comprises a key operated locking tab which directly blocks the cantilevered connecting element with the locking assembly in the locked state.

22. The latch assembly for a movable closure element according to claim 19 wherein the cantilevered connecting element has a length extending along a second line and is engageable with the post on the catch block assembly with the first actuating assembly moved around the second line through a range of at least 90° relative to the housing.

23. A latch assembly for a movable closure element having first and second sides, the latch assembly comprising:

a housing;

a first rotor movable relative to the housing selectively between a) a latched position and b) a release position, the first rotor engageable with a strike element relative to which the movable closure element can be moved to thereby releasably maintain the movable closure element in a desired position, the first rotor biased towards the release position; and an operating assembly which is operable to change the first rotor from the latched position into the release position, the operating assembly comprising a catch block assembly that is movable selectively between a) an engaged position wherein the catch block assembly engages the first rotor to thereby maintain the first rotor in the latched position and b) a disengaged position wherein the first rotor is permitted to move from the latched position into the release position, the catch block assembly comprising a portion that moves as one piece substantially along a first line and acts against the first rotor as the catch block assembly is changed from the engaged position into the disengaged position, the operating assembly comprising a first actuating assembly for mounting on the first side of the movable closure, the first actuating assembly having a first normal state and a first release state, the first actuating assembly comprising a mounting surface to abut to the first side of the movable closure and a projecting element which projects past the mounting surface and engages the portion of the catch block assembly, wherein the first actuating assembly comprises a mounting base which defines the mounting surface and a first actuating handle which is pivotably attached to the base for movement about a first axis between normal and release positions, wherein the first actuating handle is U-shaped and defined by a graspable base and spaced first and second legs, wherein the first leg is pivotably attached to the mounting base and the projecting element is in a fixed position on the second leg so that as the actuating handle is pivoted from the normal position into the release position the projecting element moves substantially parallel to the first line as one piece with the second leg and cause the rotor to be changed from the latched position into the release position.

24. The latch assembly for a movable closure element according to claim 23 wherein the projecting element has an opening, the catch block assembly has a post, and the projecting element is engaged with the catch block assembly by directing the post into the opening in the projecting element.

25. The latch assembly for a movable closure element according to claim 24 wherein the post is maintained in the opening in the projecting element without requiring any separate fasteners acting between the projecting element and the post.

26. The latch assembly for a movable closure element according to claim 24 further comprising a locking assembly having a locked state and an unlocked state, the locking assembly in the latched state preventing movement of the first actuating handle from the normal position into the release position.

27. The latch assembly for a movable closure element according to claim 26 wherein the locking assembly comprises a key operated locking tab which directly blocks the projecting element with the locking assembly in the locked state.

28. The latch assembly for a movable closure element according to claim 24 wherein the projecting element has a length extending along a first line and is engageable with the post on the catch block assembly with the first actuating assembly moved around the first line through a range of at least 90° relative to the housing.

29. The latch assembly for a movable closure element according to claim 23 further in combination with a movable closure element having first and second sides.

30. The latch assembly for a movable closure element according to claim 23 wherein the mounting surface is substantially flat.

31. The latch assembly for a movable closure element according to claim 30 wherein the mounting base has a length and a width and the flat mounting surface extends over substantially the entire length of the base.

32. The latch assembly for a movable closure element according to claim 23 further in combination with a movable closure element having first and second sides, one of the first and second sides defined by a flat surface to which one of the first and second actuating assemblies is mounted and the first line is substantially perpendicular to a plane containing the flat surface.

33. The latch assembly for a movable closure element according to claim 23 wherein the first line is substantially straight.

34. A latch assembly for a movable closure element having first and second sides, the latch assembly comprising:

a housing, a first rotor movable relative to the housing selectively between a) a latched position and b) a release position, the first rotor engageable with a strike element relative to which the movable closure element can be moved to thereby releasably maintain the movable closure element in a desired position, the first rotor biased towards the release position; and an operating assembly which is operable to change the first rotor from the latched position into the release position, the operating assembly comprising a catch block assembly that is movable selectively between a) an engaged position wherein the catch block assembly engages the first rotor to thereby maintain the first rotor in the latched position and b) a disengaged position wherein the first rotor is permitted to move from the latched position into the release position, the catch block assembly comprising a portion that moves as one piece substantially along a first line and acts against the rotor as the catch block assembly is changed from the engaged position into the disengaged position, the operating assembly further comprising a first actuating assembly for mounting on the first side of the movable closure, the first actuating assembly having a first normal state and a first release state, the first actuating assembly having a first element directly engaging the portion of the catch block assembly, moving substantially parallel to the first line, and causing the catch block assembly to change from the engaged position into the disengaged position as an incident of the first actuating assembly changing from the first normal state into the first release state.

35. The latch assembly for a movable closure element according to claim 34 further in combination with a movable closure element having first and second sides, one of the first and second sides defined by a flat surface to which one of the first and second actuating assemblies is mounted and the first line is substantially perpendicular to a plane containing the flat surface.

36. The latch assembly for a movable closure element according to claim 34 wherein the first line is substantially straight.

37. In combination:

a) a latch assembly for a movable closure element having first and second sides, the latch assembly comprising:

a housing, a first rotor movable relative to the housing selectively between a) a latched position and b) a release position, the first rotor engageable with a strike element relative to which the movable closure element can be moved to thereby releasably maintain the movable closure element in a desired position, the first rotor biased towards the release position; and an operating assembly which is operable to change the first rotor from the latched position into the release position, the operating assembly comprising a catch block assembly that is movable selectively between a) an engaged position wherein the first rotor is maintained in the latched position and b) a disengaged position wherein the rotor is permitted to move from the latched position into the release position, the catch block assembly comprising a portion that moves as one piece substantially along a first line and acts against the first rotor as the catch block assembly is changed from the engaged position into the disengaged position, the operating assembly further comprising a first actuating assembly for mounting on the first side of the movable closure, the first actuating assembly having a first normal state and a first release state, the first actuating assembly having a first element directly engaging the portion of the catch block assembly, moving substantially parallel to the first line, and causing the catch block assembly to change from the engaged position into the disengaged position as an incident of the first actuating assembly changing from the first normal state into the first release state; and b) a movable closure element having first and second sides, one of the first and second sides defined by a flat surface to which the first actuating assembly is mounted, wherein the first line is substantially perpendicular to a plane containing the flat surface.

* * * * *